US011530563B2

(12) United States Patent
Tschanz

(10) Patent No.: US 11,530,563 B2
(45) Date of Patent: Dec. 20, 2022

(54) AUTOMATIC DOOR SYSTEM, IN PARTICULAR IN THE FORM OF A SLIDING DOOR OR A TELESCOPIC SLIDING DOOR OR A FOLDING DOOR

(71) Applicant: AGTATEC AG, Fehraltorf (CH)

(72) Inventor: Peter Tschanz, Gerlikon (CH)

(73) Assignee: AGTATEC AG, Fehraltorf (CH)

( * ) Notice: Subject to any disclaimer, the term of this patent is extended or adjusted under 35 U.S.C. 154(b) by 150 days.

(21) Appl. No.: 16/753,454

(22) PCT Filed: Oct. 5, 2018

(86) PCT No.: PCT/EP2018/077162
§ 371 (c)(1),
(2) Date: Apr. 3, 2020

(87) PCT Pub. No.: WO2019/068881
PCT Pub. Date: Apr. 11, 2019

(65) Prior Publication Data

US 2020/0318409 A1 Oct. 8, 2020

(30) Foreign Application Priority Data

Oct. 5, 2017 (DE) ..... 10 2017 123 074.2

(51) Int. Cl.
*E05D 15/00* (2006.01)
*E05D 15/06* (2006.01)
(Continued)

(52) U.S. Cl.
CPC ..... *E05D 15/066* (2013.01); *E05B 65/087* (2013.01); *E05B 65/0882* (2013.01);
(Continued)

(58) Field of Classification Search
CPC ..... E05D 15/0656; E05F 15/652
(Continued)

(56) References Cited

U.S. PATENT DOCUMENTS 4,833,848 A * 5/1989 Guerin ..... E04B 2/7403 52/242
5,253,452 A * 10/1993 Goldbach ..... B60J 5/062 49/128
(Continued)

FOREIGN PATENT DOCUMENTS

DE 10 2009 058 922 6/2011
DE 10 2007 003 904 3/2017
(Continued)

OTHER PUBLICATIONS

International Search Report and Written Opinion of the ISA for PCT/EP2018/077162 dated Apr. 24, 2019, 22 pages (w/ partial translation).

*Primary Examiner* — Daniel J Troy
*Assistant Examiner* — Daniel Alvarez
(74) *Attorney, Agent, or Firm* — Nixon & Vanderhye P.C.

(57) ABSTRACT

The invention relates to an automatic door system including a first door leaf of a first door leaf arrangement that can be displaced in the longitudinal direction. A floor-side guide rail arrangement extends in the longitudinal direction and includes a first floor rail arrangement. The at least one first door leaf includes an engagement element which is arranged on an underside of the at least one first door leaf. The at least one first floor rail arrangement includes at least one first floor rail and at least one connection and/or functional element, wherein the at least one connection and/or functional element is arranged on an end side of the at least one first floor rail. The at least one first floor rail includes at least one first guide groove extending in the longitudinal direction. The at least one engagement element of the at least one first door leaf of the at least one first door leaf arrangement is inserted into the at least one first guide groove and is guided in the longitudinal direction by the at least one first guide groove.

20 Claims, 19 Drawing Sheets

(51) Int. Cl.

| | |
|---|---|
| ***E05F 15/60*** | (2015.01) |
| ***E05B 65/08*** | (2006.01) |
| ***E05F 7/00*** | (2006.01) |
| ***E06B 7/18*** | (2006.01) |

(52) U.S. Cl.
CPC ..... *E05D 15/0656* (2013.01); *E05F 7/00* (2013.01); *E05F 15/60* (2015.01); *E06B 7/18* (2013.01); *E05Y 2900/132* (2013.01)

(58) Field of Classification Search
USPC ..... 40/362
See application file for complete search history.

(56) References Cited

U.S. PATENT DOCUMENTS

| | | | | |
|---|---|---|---|---|
| 2006/0236613 | A1 | 10/2006 | Ewing | |
| 2008/0245027 | A1* | 10/2008 | Lambertini | E06B 3/26347 29/897.312 |
| 2010/0031579 | A1* | 2/2010 | Choi | B61B 1/02 49/503 |
| 2010/0281812 | A1* | 11/2010 | Haab | E06B 3/62 52/656.5 |
| 2015/0033633 | A1* | 2/2015 | Tarrega Lloret | E06B 7/16 49/406 |
| 2017/0191303 | A1* | 7/2017 | Purdom | E06B 3/46 |
| 2018/0209192 | A1* | 7/2018 | Selvaag | E05D 15/06 |
| 2018/0320437 | A1* | 11/2018 | Dintheer | E06B 7/215 |

FOREIGN PATENT DOCUMENTS

| | | |
|---|---|---|
| EP | 1 978 198 | 10/2008 |
| ES | 1170658 U * | 11/2016 |
| FR | 2 685 313 | 6/1993 |

* cited by examiner

1

AUTOMATIC DOOR SYSTEM, IN PARTICULAR IN THE FORM OF A SLIDING DOOR OR A TELESCOPIC SLIDING DOOR OR A FOLDING DOOR

This application is the U.S. national phase of International Application No. PCT/EP2018/077162 filed Oct. 5, 2018 which designated the U.S. and claims priority to DE Patent Application 10 2017 123 074.2 filed Oct. 5, 2017, the entire contents of each of which are hereby incorporated by reference.

The invention relates to an automatic door system, in particular in the form of a sliding door or a telescopic sliding door or a folding door.

Automatic door systems serve to allow and prevent access to particular rooms. The door systems operate automatically; in other words, it is detected by way of sensors whether a person is located in the vicinity, and if detection is successful the passage is opened by displacing the door leaf. Subsequently, the door leaf is held open for a while longer and displaced back into the closed position. The closed position is also important because it prevents the building interior from being excessively heated during high external temperatures in summer and excessively cooled during low external temperatures in winter. The door leaves are therefore often in movement, and the guide rails are exposed to corresponding stress. As well as a displaceable door leaf, there are also stationary leaves or corresponding glass panes. These are also part of the door arrangement, and often use the same mechanical fixing points.

DE 10 2009 058 922 A1 describes a guide for a sliding leaf. For this purpose, exactly one floor rail is provided, and has a groove in which a door leaf engages via a blade on the lower face of said leaf. The door leaf is displaceable with respect to the floor rail. An end cap is placed on one end of the floor rail, and comprises at the floor region a hose connector for connection to a drainage hose. This end cap thus never enters into engagement with the door leaf.

From DE 10 2007 003 904 B4, a door arrangement of this type together with a floor threshold is known. This door arrangement comprises both a displaceable door leaf and a stationary door leaf. A floor threshold comprising a corresponding sealing device ensures that no water can penetrate into the foundation below and that barrier-free passage is nevertheless possible. The floor threshold comprises, on the lower face thereof, corresponding connection means, which are spaced different distances apart in such a way that they can engage selectively in different widening profiles.

A drawback of DE 10 2007 003 904 B4 is that the construction of the door arrangement, in particular as regards the floor rail, is complex, and a change is not possible directly during assembly.

Therefore, the object of the present invention is to provide an automatic door system which, in particular as a result of the floor-side guide rail arrangement thereof, can be constructed as simply as possible and simultaneously exhibits low wear in operation.

The object is achieved by claim 1 for the automatic door system. Advantageous developments of the automatic door system according to the invention are set out in claims 2 to 20.

The automatic door system according to the invention is in particular formed as a sliding door or a telescopic sliding door or a folding door. It comprises at least one first door leaf arrangement that has a first door leaf that can be displaced on a first length sub-stage in the longitudinal direction of the door system. Further, at least one first drive device is provided, which is operatively connected to the at least one first door leaf or the at least one first door leaf device in such a way that the at least one first door leaf is displaceable along the first length sub-stage. Moreover, a floor-side guide rail arrangement is additionally provided, which extends in the longitudinal direction and comprises at least one first floor rail arrangement. The at least one first door leaf of the at least one first door leaf arrangement comprises an engagement element, the engagement element being arranged on the lower face of the at least one first door leaf. The at least one first floor rail arrangement comprises at least one first floor rail and at least one connection and/or functional element. The connection and/or functional element is arranged and/or fixed on an end face of the at least one first floor rail, causing the floor rail to be lengthened in the longitudinal direction. The at least one first floor rail comprises the at least one first guide groove extending in the longitudinal direction. The at least one engagement element of the at least one first door leaf of the at least one first door leaf arrangement dips into the at least one first guide groove, and is guided in the longitudinal direction by the at least one first guide groove. The at least one first floor rail arrangement further comprises at least one second floor rail, which extends in the longitudinal direction. The first and the second floor rail each comprise an upper wall segment and two lateral wall segments, which connect to the upper wall segment and together enclose a cavity extending in the longitudinal direction, the first and/or second floor rail, in cross section, in the peripheral direction:

a) being closed by a lower wall segment adjacent to the two side wall segments;

b) or being open at least in portions towards the floor, and the first and the second floor rail having, at least on the first end faces thereof, an engagement opening through which the cavity is accessible. The at least one connection and/or functional element comprises at least one upper wall segment and two lateral wall segments, which connect to the upper wall segment, and is arranged between two first end faces, facing towards one another, of the two floor rails, and interconnects these two floor rails in the longitudinal direction. The at least one connection and/or functional element has a lower thermal conductivity than the at least one first and the at least one second floor rail of the at least one first floor rail arrangement. The first floor rail, the second floor rail and the connection and/or functional element arranged between the two floor rails thus extend together along a straight line.

The use of the at least one connection and/or functional element, which is arranged on an end face of the at least one first floor rail and connected thereto, is particularly advantageous. A connection and/or functional element provides additional functions for the door system. For example, it is thus possible that further functions can be added in a particularly simple manner, while at the same time merely standard floor rails are used. Because the connection and/or functional element lengthens the first floor rail, it is also possible to use, for the first floor rail, lengths that are less than the length of the corresponding first length sub-stage in which the door leaf is displaced. This is particularly advantageous because usually the floor rails are only produced in one length, and the remainders have to be thrown away after cutting to length, since they are simply too short for another installation. By contrast, the connection and/or functional element along with the additional functions thereof can be tested directly in production, and merely remains to be inserted at the assembly site.

In this case, the connection and/or functional element comprises, on the first and second end face, a fixing projection, which engages in the engagement openings of the associated first end faces of the two floor rails, causing the first and second floor rail to be mechanically stably interconnected via the connection and/or functional element. As a result, two floor rails, which may be of different length, can be interconnected. This means that it is also possible to use floor rails that are per se shorter than the first length sub-stage or that are shorter than the extension of the floor-side guide rail arrangement in the longitudinal direction.

In a particularly preferred embodiment, the at least one connection and/or functional element is arranged in the first floor rail arrangement in such a way that, in a closed position of the at least one first door leaf of the at least one first door leaf arrangement, a secondary closing edge of the at least one first door leaf is positioned approximately above the at least one connection and/or functional element. A closed position of this type is adopted for a relatively long time, in particular at night. Since the doorframe and the floor rails consist of metal (in particular aluminium), the high heat transmission resistance due to the connection and/or functional element between the first and second floor rail of the first floor rail arrangement is not spoiled by the two floor rails having direct contact with the lower face of the door leaf, which would then act as a thermal conductor. Instead, in the closed position, the first door leaf only comes to rest on a floor rail and the connection and/or functional element.

In a further preferred configuration, the first guide groove extends from the first floor rail via the connection and/or functional element into (or along) the second floor rail of the first floor rail arrangement.

In an advantageous embodiment of the automatic door system, the at least one connection and/or functional element further comprises a holding device that is formed to hold a door structure such as a doorframe or glass frame. For this purpose, the holding device preferably comprises a holding and positioning projection, which protrudes from the upper wall segment and is formed to hold the door structure. Alternatively, the holding device comprises a holding and positioning opening, which is accessible from the upper wall segment and is formed to receive projections from a lower face of the door structure and thus to hold the door structure.

In this context, it is particularly advantageous that the associated floor rails can be manufactured in a standardised manner and cut to a particular length, special functions merely being taken on by the at least one connection and/or functional element. The connection and/or functional element may also be manufactured in advance, and has standardised dimensions. During installation, the floor rails are cut to the corresponding length and interconnected by way of the connection and/or functional element, which, in this case, also additionally carries the door structure. As a result of the floor rails being correspondingly cut to the appropriate length, the connection and/or functional element is always arranged in the correct position.

In a further preferred embodiment of the automatic door system, the connection and/or functional element further comprises a locking receiving opening, which is formed to receive a locking bolt, which can be extended out from a lower face of the at least one first door leaf of the at least one door leaf arrangement or which is part of a closing cylinder. In this context, it is advantageous that this locking receiving opening can be introduced ex works and if appropriate can further be made reinforced. The floor rails themselves do not have to be post-processed specially, and so they may further very favourably be produced for example as extrusions. They may also be produced as bent and/or rolled parts.

It is further advantageous if the connection and/or functional element further comprises a hook lock as well as a release device. In this context, the hook lock is arranged displaceably (for example rotatably and/or pivotably) in the at least one connection and/or functional element, and can be moved and/or pivoted and/or flapped and/or snapped from a release position, in which the at least one first door leaf of the at least one first door leaf arrangement is displaceable along the longitudinal direction, into a blocking position, in which the at least one door leaf is locked stationary. In the blocking position the hook lock engages in a fixing opening on the lower face of the at least one door leaf, and in the release position it is preferably arranged completely within the connection and/or functional element. The release device is formed to transfer the hook lock from the release position into the blocking position and back. A hook lock of this type ensures that the door leaf cannot simply be pulled away.

The release device is advantageously arranged below the locking receiving opening in the at least one connection and/or functional element. The locking bolt, in the state where it engages in the locking receiving opening, contacts the release device, causing the release device to bring about the displacement of the hook lock from the release position into the blocking position. Preferably, in this case, the connection and/or functional element further comprises an energy store device, in particular in the form of a spring device, which is formed to displace the hook lock from the blocking position into the release position while contact of the release device by the locking bolt remains absent. The locking device is in particular formed in such a way that in the event of a power failure the locking bolt is pulled out of the locking receiving opening, the energy store device simultaneously ensuring that the hook lock is transferred from the blocking position into the release position. In this case, the door can reliably be slid open in the event of a power failure.

In a preferred development, the at least one connection and/or functional element may also have additional functions. Thus, at least one heating element, preferably in the form of a heating wire, may be arranged therein. It is also possible for the at least one first drive device or at least part of the at least one first drive device, in the form of an electric motor and a spindle driven by the electric motor, to be arranged therein. Power and/or data cables may also be arranged therein. A control device comprising a circuit board may also be arranged in the at least one connection and/or functional element. It is also possible for a sensor device to be arranged in said element, the sensors monitoring, via the sensor field thereof, the environment outside the connection and/or functional element. In this context, an LED device may also be arranged so as to make lighting possible. Small monitors and/or loudspeaker devices may also be arranged in the connection and/or functional element. It is also possible for the connection and/or functional element to be pierced by drainage openings, so as to pass water into a carrier profile extending below the at least one connection and/or functional element. It is noted that these functions may also be provided in the first and/or second floor rail.

Particularly preferably, the door system, and therein the floor-side guide rail arrangement, further comprises at least one second floor rail arrangement, which extends parallel to the first floor rail arrangement. The second floor rail arrangement is constructed like the first floor rail arrangement, and comprises at least one second guide groove, which likewise extends in the longitudinal direction. The at least one first door leaf arrangement comprises a second door leaf, which comprises an engagement element that dips into the second guide groove in the longitudinal direction and is guided by said groove. The second floor rail arrangement likewise comprises a first floor rail and at least one connection and/or functional element, which in turn is arranged and/or fixed on the end face of the at least one first floor rail and lengthens it along the longitudinal axis, in other words in the longitudinal direction. The at least one first door leaf arrangement is thus formed as a telescopic sliding door, the at least one first door leaf and the at least one second door leaf being formed as sliding door leaves, which extend mutually parallel in different guide grooves and along stages of different length. As a result of the use according to the invention of a plurality of floor rail arrangements, different door types can be implemented. Thus, the individual floor rails of the different floor rail arrangements may be of different length, and thus be assembled from available pieces of the available floor rails. Different floor rails of a floor rail arrangement may also merely serve to fix door structures, for example.

In a further embodiment according to the invention of the door system, the floor-side guide rail arrangement further comprises at least one carrier profile, which likewise extends in the longitudinal direction and is arrangeable or arranged in a recess in the floor. The at least one carrier profile comprises a base wall and side walls, which delimit a shared receiving space, said space being accessible from an upper face (which faces a lower face of the door leaf) of the at least one carrier profile. The carrier profile comprises at least two support regions, which are spaced apart from one another, each support region being arranged between the upper face and the base wall and extending at least along a particular length in the longitudinal direction. The at least one first floor rail arrangement is positioned in each case on an upper support face of the support regions facing towards the at least one first door leaf. As a result, a very stable guide rail arrangement can be provided. Thus, the carrier profile can be rigidly anchored in the recess in the floor, and the individually assembled first floor rail arrangement can be laid on the corresponding support regions. So as still to be able to achieve thermal decoupling when required, a thermal insulation element, which in particular consists of a dielectric medium, is preferably arranged between the one first floor rail arrangement and the upper support faces of the first support region and of the second support region.

The at least one carrier profile may preferably also serve for drainage. In this case, the carrier profile is preferably formed watertight and/or arranged above a sealing film that encloses the base wall and the side walls. The carrier profile is sealed (in a moisture-proof manner) at the end walls, at least one end wall comprising, in the region of the base wall, an opening preferably having at least one tubular projection that serves to connect to a drainage pipe or drainage hose. As a result, masses of water that penetrate into the carrier profile through drainage openings in the first floor rail arrangement can be discharged.

Various embodiments of the invention are described in the following with reference to the drawings. Like subject matters have like reference numerals. In detail, in the corresponding drawings.

Figure 1:
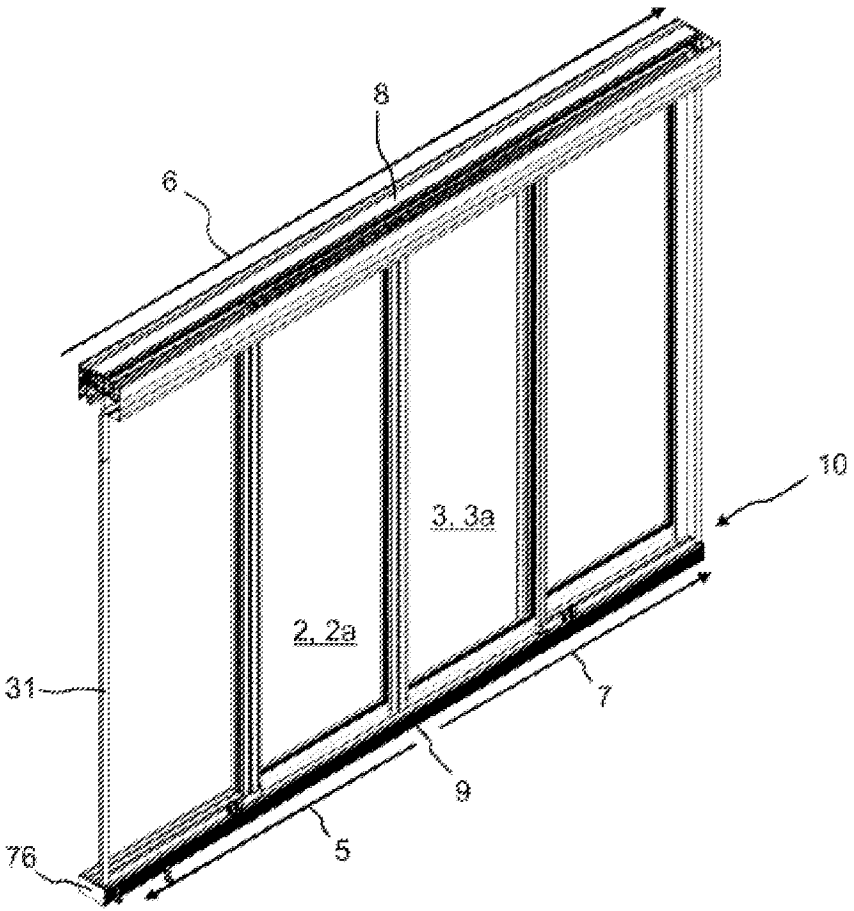
FIG. 1 is a three-dimensional drawing of the door system according to the invention.

FIG. 1 is a three-dimensional drawing of the automatic door system 1 according to the invention, which is a sliding door. In principle, it could also be a telescopic sliding door or a folding door. In the embodiment, a first door leaf arrangement 2 and a second door leaf arrangement 3 are shown. The first door leaf arrangement 2 comprises a first door leaf 2*a*, which is displaceable in the longitudinal direction 6 of the door system 1 on a first sub-stage 5. The second door leaf arrangement 3 likewise comprises a first door leaf 3*a*. This is displaceable in the longitudinal direction 6 of the door system 1 on a second sub-stage 7. The two sub-stages 5, 7 are of the same length or different length. The at least one first door leaf 2*a* of the at least one first door leaf arrangement 2 or the at least one first door leaf 3*a* of the at least one second door leaf arrangement 3 are movable towards one another or movable away from one another. A passage can thus be closed or opened.

This movement is performed by at least one first drive device, which is operatively connected to the at least one first door leaf 2*a* of the at least one first door leaf arrangement 2. As a result, the at least one first door leaf 2*a* is displaceable along the first sub-stage 5. The same also applies to the first door leaf 3*a* of the second door leaf arrangement 3. The at least one first drive device or a further drive device is operatively connected to this door leaf 3*a* in such a way that the at least one first door leaf 3*a* of the at least second door leaf arrangement 3 is displaceable in the longitudinal direction 6 of the door system 1 along the second sub-stage 7. The first and second door leaf arrangement 2, 3 are fixed or guided displaceably in a ceiling-side guide rail arrangement 8 and a floor-side guide rail arrangement 9. The floor-side guide rail arrangement 9 extends in the longitudinal direction 6, as does the ceiling-side guide rail arrangement 8. The floor-side guide rail arrangement 9 comprises at least one first floor rail arrangement 10. The at least one first door leaf 2*a* of the at least one first door leaf arrangement 2 comprises an engagement element 11 (see FIG. 15), which is arranged on a lower face 12 of the at least one first door leaf 2*a*. The engagement element 11 is for example a guide blade. The first door leaf 2*a* is in the form of a sliding door leaf. The guide blade is thus arranged along the predominant or the entire length of the sliding door leaf extending in the longitudinal direction 6. If the first door leaf 2*a* is a door leaf 2*a* of a folding door, the engagement element 11 comprises a guide bolt. The guide bolt is likewise arranged on the lower face 12 of the at least one first door leaf 2*a*. In particular, in this case merely the door leaf 2*a* comprises the guide bolt, the end of which is not fixed stationary on a wall but rather mounted pivotably or rotatably on another door leaf.

Figure 2:
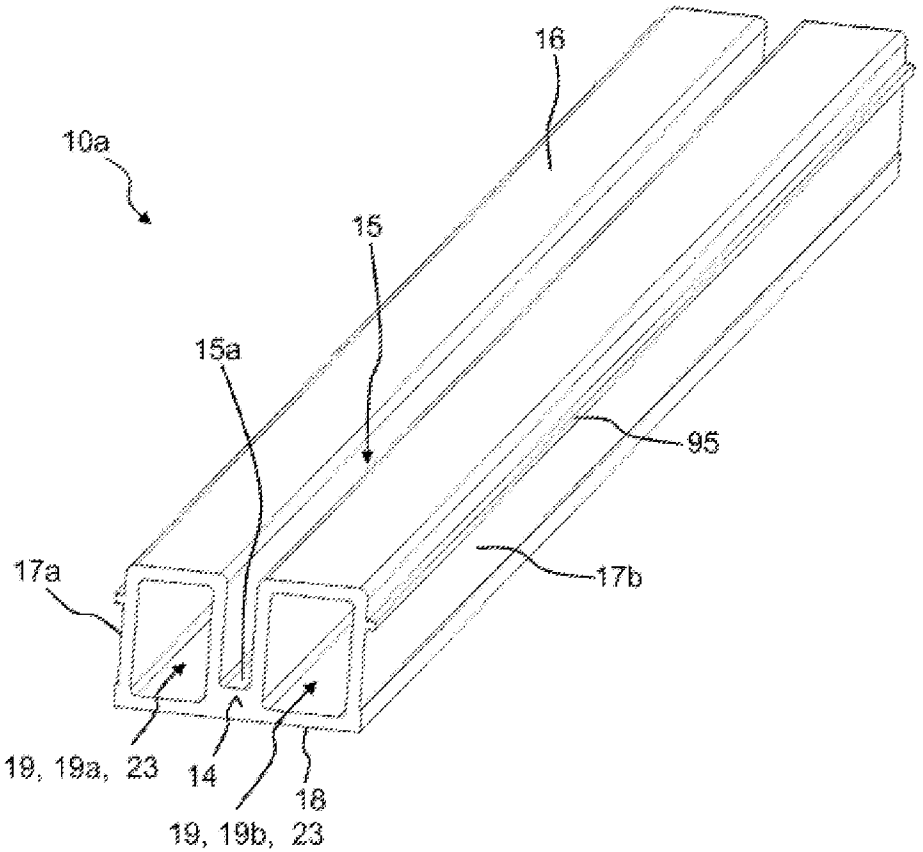
FIG. 2 is a three-dimensional drawing of a first floor rail.
Figure 3B:
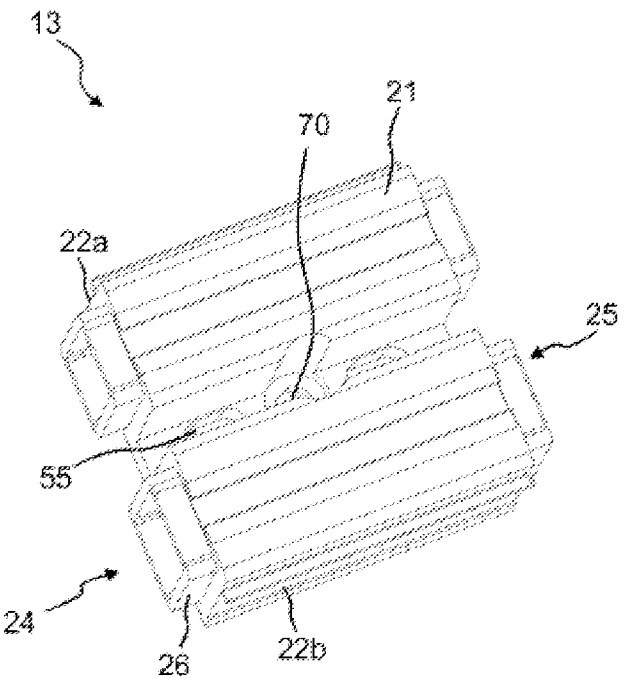
FIG. 3A, 3B are various three-dimensional drawings of a connection and/or functional element.
Figure 3A:
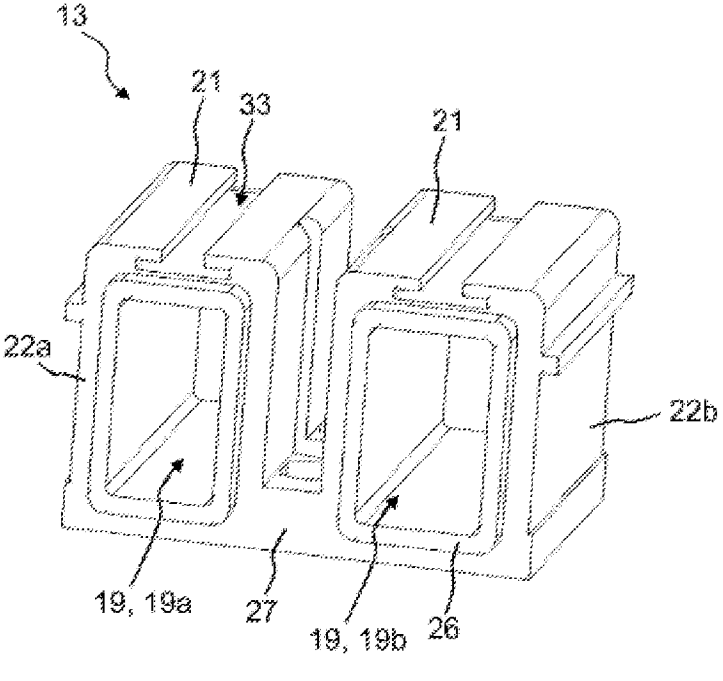

The at least one first floor rail arrangement 10 (see FIG. 4) comprises at least one first floor rail 10*a*, which is shown for example in FIG. 2, and at least one connection and/or functional element 13, such as is shown for example in FIGS. 3*a* and 3B. The at least one connection and/or functional element 13 is arranged and/or fixed on an end face 14 of the at least one first floor rail 10*a*. This lengthens the first floor rail 10*a* in the longitudinal direction 6.

The first floor rail 10*a* in FIG. 2 moreover comprises at least one first guide groove 15 extending in the longitudinal direction 6. The at least one engagement element 11 of the at least one first door leaf 2*a* of the at least one first door leaf arrangement 2 dips into the at least one first guide groove 15, and is guided thereby at least in the longitudinal direction 6. The wording "guided in the longitudinal direction 6" means that movements transverse or perpendicular (lateral) to the longitudinal direction 6 are thus prevented. However, removal of the engagement element 11 is usually possible. A different situation could arise if the at least one first guide groove 15 is for example formed T-shaped or L-shaped in cross section and comprises an undercut support region in which the engagement element 11, likewise formed T-shaped or L-shaped, engages. In this case, removal upwards, in other words towards the ceiling-side guide rail arrangement 8, would no longer be possible.

In principle, it would also be possible for the at least one engagement element 11 to be assisted in the guidance by additional rollers.

Figure 4:
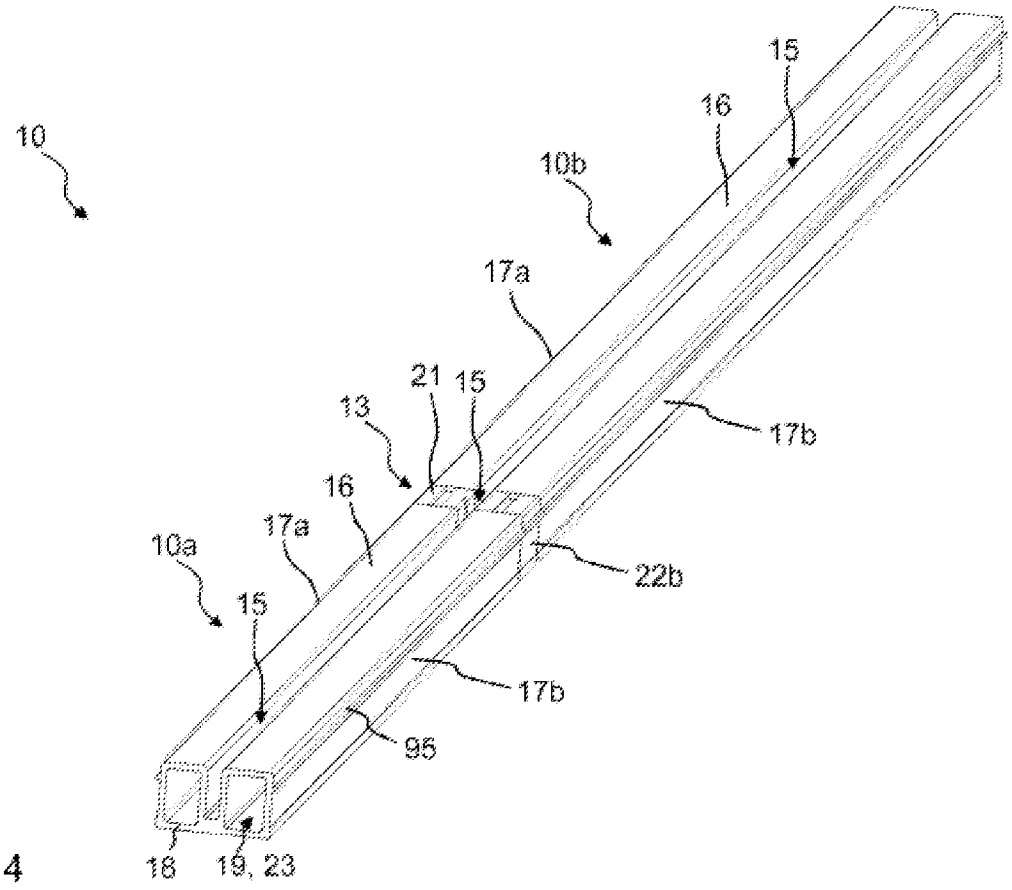
FIG. 4 is a three-dimensional drawing of the first floor rail arrangement.

In FIG. 4, the at least one first floor rail arrangement 10 further comprises at least one second floor rail 10*b*, which likewise extends in the longitudinal direction 6. The first and second floor rail 10*a*, 10*b* are of the same length or different length. The first and second floor rail 10*a*, 10*b* comprise an upper wall segment 16 and two lateral wall segments 17*a*, 17*b*. The two lateral wall segments 17*a*, 17*b* are attached to the upper wall segment 16 and together enclose a cavity 19 extending in the longitudinal direction 6. Moreover, it is shown that in cross section the first and the second floor rail 10*a*, 10*b* are (fully) closed in the peripheral direction by a lower wall segment 18 adjacent to the two side wall segments 17*a*, 17*b*. The wording "fully" should be understood to mean that holes may still preferably be introduced. In principle, it would also be possible for the first and/or second floor rail 10*a*, 10*b* to be open at least in portions towards the floor. In this case, the lower wall segment 18 would preferably be omitted completely.

Moreover, there may also be arbitrarily many further floor rails (third, fourth, fifth, sixth, etc.), which are arranged mutually parallel. In this case, the construction corresponds to the previous ones.

Both the first and the second floor rails 10*a*, 10*b* comprise a first end face 14. These first end faces 14 have an engagement opening 23, through which the cavity 19 is accessible from outside the floor rails 10*a*, 10*b*.

The at least one connection and/or functional element 13 also comprises at least one upper wall segment 21 and two lateral wall segments 22*a*, 22*b*, which connect to the upper wall segment 21. The at least one connection and/or functional element 13 is arranged between two first end faces 14, facing towards one another, of the two floor rails 10*a*, 10*b*.

The at least one connection and/or functional element 13 comprises, on each of the first and the second end face 24, 25 thereof (FIG. 3B), a fixing projection 26. The fixing projection 26 on the first end face 24 of the at least one connection and/or functional element 13 engages in the engagement opening 23 on the first end face 14 of the first floor rail 10*a*. The fixing projection 26 on the second end face 25 of the at least one connection and/or functional element 13 engages in the engagement opening 23 on the first end face 14 of the second floor rail 10*b*.

The fixing projection 26 could also further comprise additional latching means, making it more difficult to remove the connection and/or functional element 13 from the associated first or second floor rail 10*a*, 10*b*. A locking means of this type could for example be in the form of a ball latch.

In principle, it would also be possible for a further sealing means to be arranged between the at least one connection and/or functional element 13 and the associated first and second floor rail 10*a*, 10*b*. A sealing device of this type preferably consists of a plastics material and is also preferably formed on the connection and/or functional element 13 as a sealing lip, in particular injected onto the fixing projection 26 or close to the fixing projection 26. Preferably, the connection and/or functional element 13 consists of or comprises plastics material, in which case the sealing device is also preferably injected onto the connection and/or functional element 13 by 2K injection.

In this context, the at least one connection and/or functional element 13 is arranged in the first floor rail arrangement 10 in such a way that, in a closed position of the at least one first door leaf 2*a* of the at least one first door leaf arrangement 2, a secondary closing edge of the at least one first door leaf 2*a* is positioned over the at least one connection and/or functional element 13. As a result, particularly good thermal decoupling of the floor-side guide rail arrangement 9 is achieved. In particular, the at least one connection and/or functional element 13 has a lower thermal conductivity than the associated first and second floor rail 10*a*, 10*b*.

As a result, the first floor rail arrangement 10 has a non-constant heat transfer resistance in the longitudinal direction.

In principle, the at least one connection and/or functional element could also consist of metal or comprise metal.

The first floor rail 10*a* and/or the second floor rail 10*b* of the first floor rail arrangement 10 preferably consist of metal, and are also preferably produced as extrusions. In principle, it would also be possible for them to be formed of plastics material or to comprise plastics material.

FIG. 2 shows that the at least one first guide groove 15 extends in the first floor rail 10*a* within the upper wall segment 16. The first floor rail 10*a* is closed in cross section, resulting in the upper wall segment 16 extending offset towards the opposite lower wall segment 18 in the region of the groove base 15*a* of the first guide groove 15, and being connected to said segment, resulting in the cavity 19 being subdivided or broken up into two mutually separate chambers 19*a*, 19*b* extending in the longitudinal direction 6. It would also be possible for the groove base 15*a* of the first guide groove 15 to end spaced apart from the opposite lower wall segment 18. In this case, the cavity 19 would not be divided into different chambers 19*a*, 19*b*. In accordance with FIG. 4, the same statements also apply to the second floor rail 10*b*. This is likewise passed through by the first guide groove 15. In principle, it would also be possible for the second floor rail 10*b* to be free of the guide groove 15 in the upper wall segment 16 thereof. In principle, it would also be possible for the first floor rail 10*a* and/or second floor rail 10*b* to be separated by the at least one first guide groove 15 into two mutually separated delimiting profiles, which extend parallel and are in particular square tubes. In this case, the at least one first guide groove 15 would pass fully through the first floor rail 10*a* and/or second floor rail 10*b*.

Figure 11:
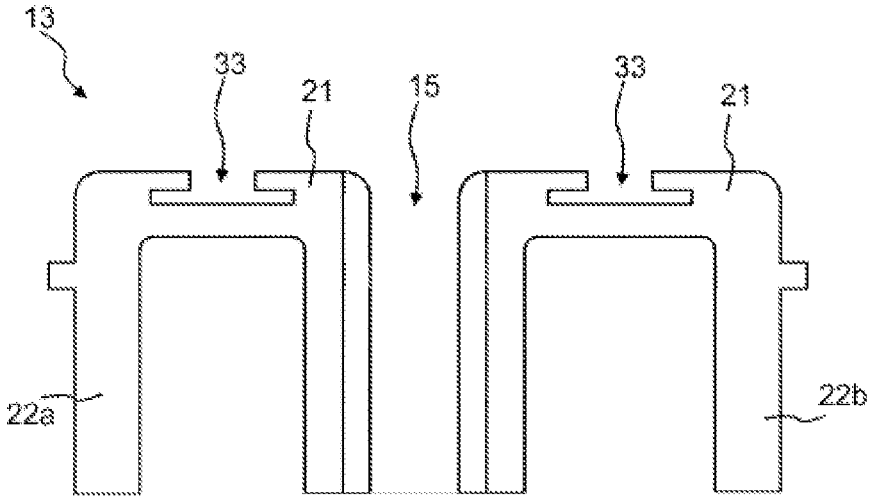
FIG. 11 shows a connection and/or functional element that is open towards the floor.
Figure 15:
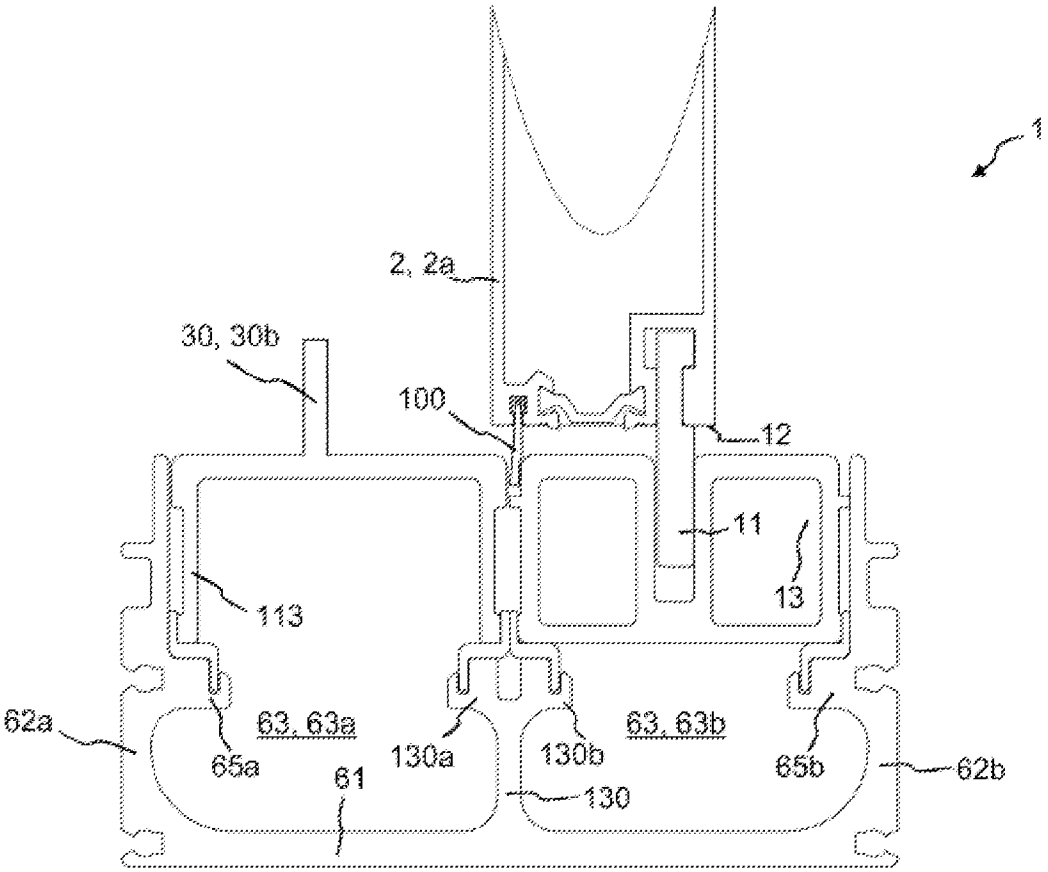
FIG. 15 is a cross section through a floor-side guide rail arrangement comprising the further carrier profile.

It would also be possible for the first floor rail 10*a* to be open in cross section towards the floor, in other words away from a lower face 12 of the first door leaf 2*a*, the walls of the guide groove 15 extending approximately parallel to the lateral wall segments 17*a*, 17*b* of the first floor rail 10*a*. The same could likewise apply to the second floor rail 10*b*. If the second floor rail 10*b* is free of a guide groove 15, the second floor rail 10*b* would in this case be configured U-shaped in cross section. FIGS. 11 and 15 show that this state of affairs may also apply to the at least one connection and/or functional element 13. In these drawings, the at least one connection and/or functional element 13 is open in cross section towards the floor (towards a carrier profile 60), the walls of the guide groove 15 extending approximately parallel to the lateral wall segments 22*a*, 22*b* of the at least one connection and/or functional element 13 that connect to the upper wall segment 21.

By contrast, in FIG. 3A the at least one connection and/or functional element 13 is closed in cross section, resulting in the upper wall segment 21 extending offset towards an opposite lower wall segment 27 in the region of the groove base 15*a* and being connected to said segment, resulting in the cavity 19 being subdivided into two mutually separated chambers 19*a*, 19*b*. In this case too, the region of the groove base 15*a* of the first guide groove 15 that extends offset towards the opposite lower wall segment 27 could end spaced apart from said segment.

It is not shown that the upper wall segment 16 of the first floor rail 10*a* and/or second floor rail 10*b* of the first floor rail arrangement 10 is platinum-plated, along the entire length of the associated floor rail 10*a*, 10*b* or along a sub-length of the associated floor rail 10*a*, 10*b*, at least with a metal sheet that is adapted to the progression of the upper wall segment 16 including an optional guide groove 15. A metal plate of this type could be screwed and/or glued to the associated floor rail 10*a*, 10*b*. The metal sheet may be continuous and extend along the entire first floor rail arrangement 10 or be formed from a plurality of pieces that are positioned in succession in the longitudinal direction 6 of the first floor rail arrangement 10. The metal sheet is for example chrome-plated steel sheet.

In principle, it would also be possible for the upper wall segment 21 of the at least one connection and/or functional element 13 of the first floor rail arrangement 10 also to be platinum-plated with a metal sheet of this type, which is likewise adapted to the progression of the upper face 21.

The at least one first floor rail 10*a* and the at least one second floor rail 10*b* of the first floor rail arrangement 10 are of different length in the embodiment. They could also be of the same length. Preferably, however, the at least one first floor rail 10*a* and the at least one second floor rail 10*b* of the first floor rail arrangement 10 are longer than the at least one connection and/or functional element 13.

The connection and/or functional element 13 moreover comprises further special functions. These special functions are preferably integrated into the connection and/or functional element 13 directly during the production thereof. This facilitates the overall assembly of the door system 1. The floor rails 10*a*, 10*b* would merely need to be cut to the appropriate length, a fully pre-assembled connection and/or functional element 13, of which the special functions or functional arrangements have already been tested in advance, already being inserted.

Figure 12:
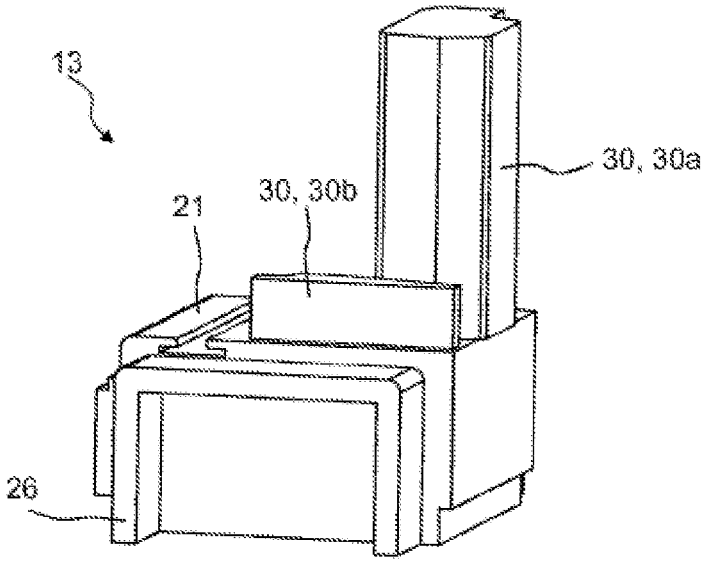
FIG. 12 shows a connection and/or functional element that comprises a casing for fixing door structures.

FIG. 12 shows that the at least one connection and/or functional element 13 comprises at least one holding device 30 and is formed to hold a door structure such as a doorframe 31 (FIG. 1) or glass frame. The holding device 30 preferably comprises a holding and positioning projection 30*a*, which protrudes from the upper wall segment 21 and is formed to hold the door structure. Alternatively, the holding device 30 comprises a holding and positioning opening, which is accessible from the upper wall segment 21 and formed to receive projections from a lower face of the door structure and thus to hold the door structure. The at least one connection and/or functional element 13 is preferably formed in one piece. This means that the holding device 30 is an integral part of the connection and/or functional element 13. The holding device 30 may also further comprise a blade 30*b*, which protrudes from the upper wall segment 21 and can be brought into engagement with a door structure. In this context, the holding device 30 serves in particular to position the door structure, since the building walls have a high tolerance (may be inclined).

Figure 5:
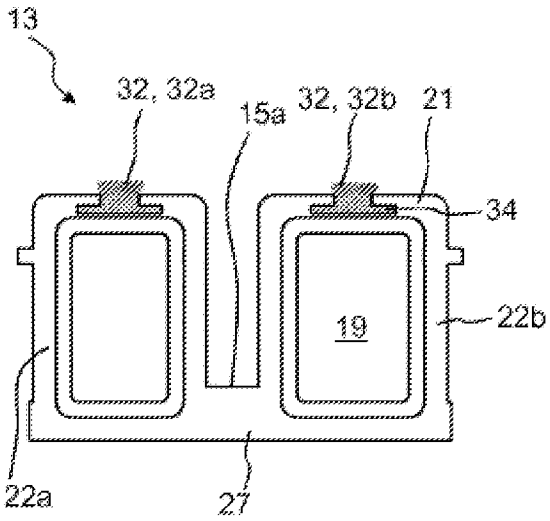
FIG. 5 is a cross section through the connection and/or functional element.

FIG. 5 moreover shows that the at least one connection and/or functional element 13 comprises at least one brush arrangement 32, which consists of at least one first brush row 32*a* that protrudes from the upper wall segment 21 towards the lower face 12 of the at least one first door leaf 2*a* of the at least one first door leaf arrangement 2. FIG. 5 also shows a further, second brush row 32*b*, which is arranged adjacent to the first brush row 32*a*. Both brush rows 32*a*, 32*b* extend in the longitudinal direction 6.

Preferably, the connection and/or functional element 13 has at the upper wall segment 21 thereof a brush groove 33, which is preferably formed T-shaped or L-shaped in cross section (see FIG. 3A). The brush rows 32*a*, 32*b* comprise a base body 34, which preferably consists of a plastics material and engages in the brush groove 33. This base body 34 is preferably only displaceable in the longitudinal direction 6 within the brush groove 33 and only actually guidable into the brush groove 33 with a movement vector extending in the longitudinal direction 6. The individual brush hairs, which protrude towards the lower face 12 of the at least one first door leaf arrangement 2, are fixed on the base body 34. As a result, it is achieved that soiling on the lower face 12 of the at least one first door leaf 2*a* does not lead to deterioration of the running performance of the door system 1, since this soiling is wiped away by the brush arrangement 32.

Figure 6A:
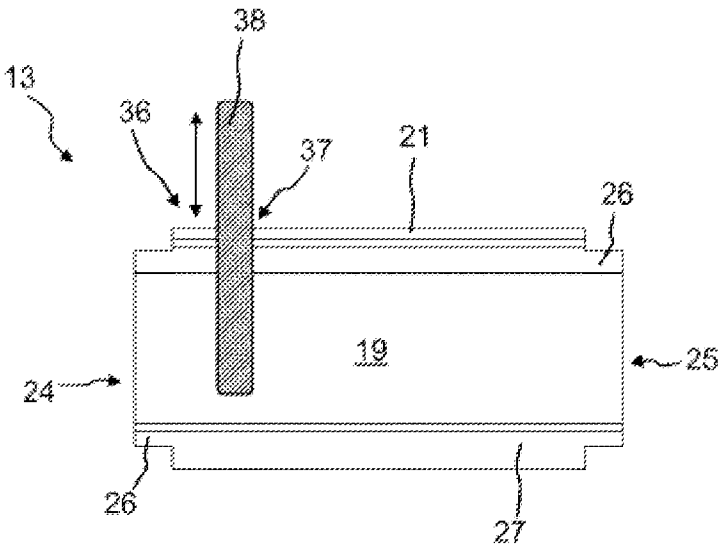
FIG. 6A to 6C are various longitudinal sections through the connection and/or functional element, showing locking of the door leaf.

FIG. 6A shows a further function of the at least one connection and/or functional element 13. It comprises a locking device 36 that comprises a locking receiving opening 37. The locking receiving opening 37 is preferably formed as an opening in the upper wall segment 21 of the at least one connection and/or functional element 13, causing the cavity 19 to be accessible from outside the connection and/or functional element 13. The locking receiving opening 37 is formed to receive a locking bolt 38, which can be extended out from a lower face 12 of the at least one first door leaf 2*a* of the at least one first door leaf arrangement 2. The locking bolt 38 is preferably pushed through the entire height of the door leaf 2*a*, in that a corresponding actuation device is introduced in the ceiling-side guide rail arrangement 8 and pushes the locking bolt 38 downwards, in other words towards the floor-side guide rail arrangement 9. However, said bolt may also be part of a locking cylinder, which is actuable manually using a key. In the locking position, the at least one first door leaf 2*a* can no longer be displaced in the longitudinal direction 6.

The locking bolt 38 may also dip through the guide blade 11 of the at least one first door leaf 2*a*. In this case, the locking receiving opening 37 is arranged in a wall segment that has come about as a result of the at least one first guide groove 15 in the at least one connection and/or functional element 13. The locking receiving opening 37 is formed to displace a locking bolt 38 from said opening into the at least one first guide groove 15, it being possible for the locking bolt 38 for example to be part of a locking cylinder. The at least one guide blade 11 of the at least one first door leaf 2*a* comprises an opening. In the closed position of the at least one first door leaf 2*a*, this opening is arranged opposite the opening of the connection and/or functional element 13. As a result, the locking bolt 38 can be inserted into the opening of the at least one guide blade 11 of the at least one first door leaf, causing said leaf to be locked.

Figure 6C:
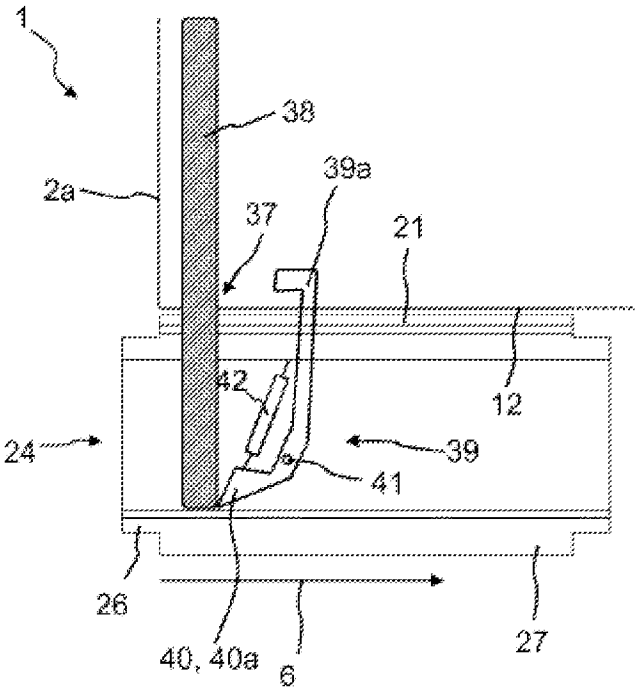

To achieve additional security against unauthorised sliding-open or breaking-open of the at least one first door leaf 2*a*, the at least one connection and/or functional element 13 comprises at least one hook lock 39 and one release device 40, which is preferably part of the hook lock 39. The hook lock 39 is mounted displaceably, in particular rotatably about an axis of rotation 41, within the cavity 19 of the at least one connection and/or functional element 13. The hook lock 39 can be moved and/or pivoted and/or flapped and/or snapped from a release position, shown in FIG. 6B, in which the at least one first door leaf 2*a* of the at least one first door leaf arrangement 2 is displaceable along the longitudinal direction 6, into a blocking position, shown in FIG. 6C. In the blocking position (FIG. 6*c*), the at least one first door leaf 2*a* is arrested in place. For this purpose, the hook lock 39 engages in a fixing opening on the lower face 12 of the at least one first door leaf 2*a*. For this purpose, the hook lock 39 comprises an engagement arm 39*a*, on the end of which a corresponding hook or portion is formed that extends transverse or perpendicular to the engagement arm 39*a*. Part of the surface of this hook or portion may also be part of the upper wall segment 21 of the at least one connection and/or functional element 13 or end flush with the surface in the release position.

The release device 40 is formed to transfer the hook lock 39 from the release position into the blocking position and back.

In the embodiment shown, the release device 40 is arranged below the locking receiving opening 37 in the at least one connection and/or functional element 13. In this case, the release device 40 comprises a release arm 40*a*, the release arm 40*a* and the engagement arm 39*a* further preferably consisting of one integral part, in other words of a shared component, which is pivotable about the axis of rotation 41. This means that the hook lock 39 is preferably constructed in a single piece. The release arm 40*a* comprises, on the open end thereof, a corresponding contact region, which the locking bolt 38 contacts in the state where it engages in the locking receiving opening. As a result, the release device 40 is activated, causing the release device 40 to bring about the displacement of the hook lock 39, in other words the rotation of the hook lock 39 about the axis of rotation 41, from the release position into the blocking position. As a result of the rotational movement (FIG. 6C), the engagement arm 39*a* is slid beyond the upper wall segment 21 of the at least one connection and/or functional element 13.

Figure 6B:
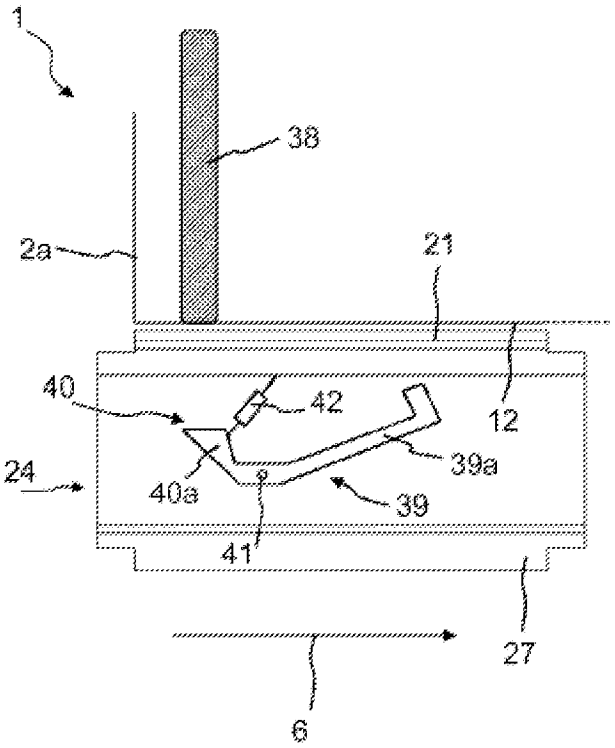

Preferably, the at least one connection and/or functional element 13 further comprises an energy store device 42, in particular in the form of a spring device. The energy store device 42 is formed to displace the hook lock 39 from the blocking position into the release position while contact of the release device 40 by the locking bolt 38 remains absent. Part of this energy store device 42 is therefore rigidly fixed or articulated on the at least one connection and/or functional element 13. The other part is fixed or articulated on the release arm 40*a*, as shown in FIG. 6B.

As a basic principle, the door system 1 has to be constituted in such a way that in the event of a power failure the locking bolt 38 does not engage in the locking receiving opening 37. In this case, the energy store device 42 ensures that the engagement arm 39*a* is disengaged from the at least one first door leaf 2*a* of the first door leaf arrangement 2. The at least one first door leaf 2*a* can therefore be slid open in the event of a power failure.

Figure 6E:
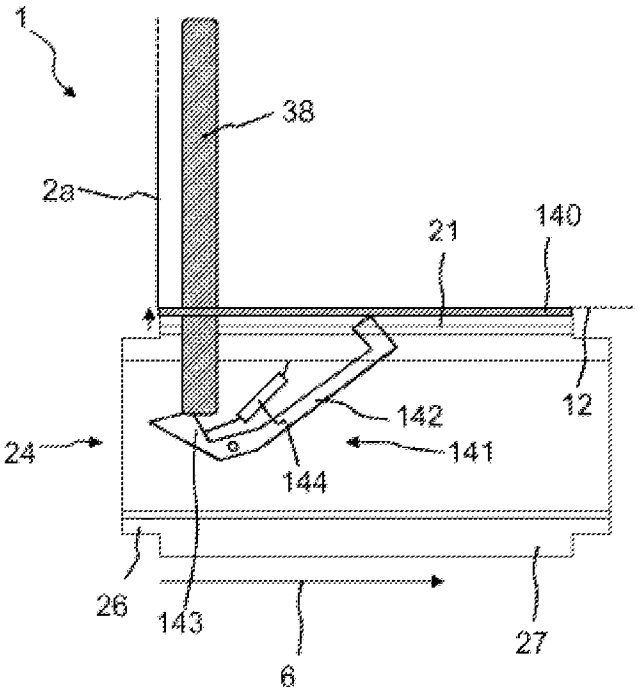
FIGS. 6D and 6E are various longitudinal sections through the connection and/or functional element, illustrating the mode of operation of a movable sealing device in greater detail.
Figure 6D:
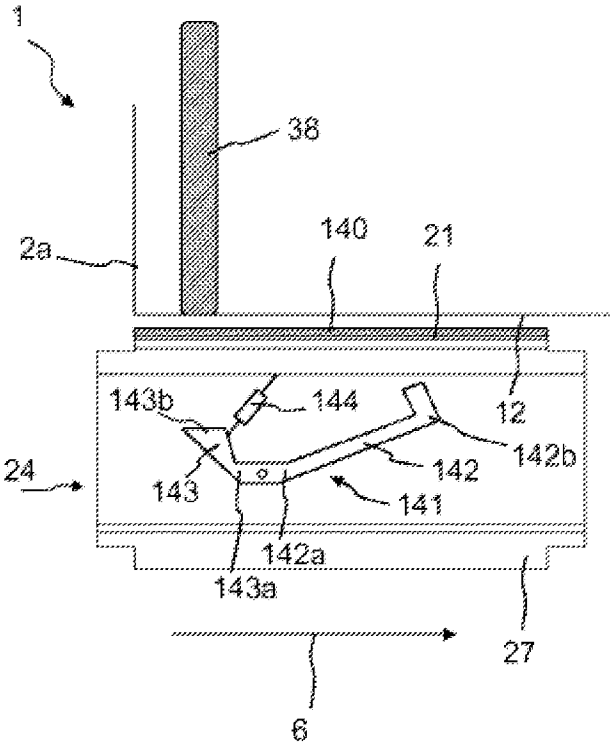

FIGS. 6D and 6E are different longitudinal sections through the connection and/or functional element 13, which illustrate the mode of operation of a movable sealing device 140 in greater detail. The movable sealing device 140 may be formed as a strip brush or as a sealing rubber. It is preferably merely movable in one plane, specifically from the upper wall segment 16 of the first and/or second floor rail 10*a*, 102*b* and/or from the upper wall segment 21 of the at least one connection and/or functional element 13 towards the lower face 12 of the at least one first door leaf 2*a*. In FIG. 6D, the movable sealing device 140 is positioned on the upper wall segment 21 of the at least one connection and/or functional element 13. In FIG. 6E, the movable sealing device 140 is pushed against the lower face 12 of the at least one first door leaf 2*a*. This happens when the at least one first door leaf 2*a* takes on or reaches the closed position thereof.

Further, a displacement device 141 is shown, which is formed to move the movable sealing device 140 from a first position (FIG. 6D), in which it is positioned against the region of the associated upper wall segment 16, 21, into a second position (FIG. 6E), towards the lower face 12 of the at least one first door leaf 2*a*. This takes place as soon as the at least one door leaf 2*a* is in the locking position, the movable sealing device 140 being in contact with the lower face 12 of the at least one first door leaf 2*a* in the closed position of the at least one first door leaf 2*a*. This wording also includes the movable sealing device 140 already being able to move towards the lower face 12 of the at least one first door leaf 2*a* as soon as the at least one first door leaf 2*a* has less than 30%, 20%, 15%, 10%, 5% of the total displacement distance thereof still to cover. In the second position, the movable sealing device 140 is in contact with the lower face 12 of the at least one first door leaf 2*a*. This prevents water or moisture being able to penetrate in. Air circulation is also prevented or reduced.

In the closed position of the at least one first door leaf 2*a*, the movable sealing device 140 is preferably arranged exclusively below the lower face 12 of the at least one first door leaf 2*a*. Preferably, during an (opening) movement of the at least one first door leaf 2*a* or during an open position of the at least one first door leaf 2*a*, the movable sealing device 140 is arranged in a receiving groove in the upper wall segment 16 of the first and/or second floor rail 10*a*, 10*b* and/or in a receiving groove in the upper wall segment 21 of the at least one connection and/or functional element 13.

The displacement device 141 may comprise an electric motor, which is formed to move the sealing device 140 towards the lower face 12 of the at least one first door leaf 2*a*. This preferably only takes place in the closed position. This also includes in particular a short displacement distance before the closed position is reached (see above, <30%).

Alternatively, the displacement device 141 comprises a lever device 141, which consists of at least two lever arms 142, 143, the first ends 142*a*, 143*a* of which are at least indirectly interconnected, the lever device 141 being mounted pivotably. An indirect connection should be understood to mean that it may also be arranged at different points on a central body, for example on a shaft. However, the movement of one lever arm 142 always leads to a movement of the other lever arm 143. The two lever arms 142, 143 may be arranged in the same plane or in different but preferably parallel planes.

A second end 142*b* of the first lever arm 142 is connected to the sealing device 140 or arranged thereon. A second end 143*b* of the second lever arm 143 is arranged in such a way that, in the closed position of the at least one first door leaf 2*a*, said end either comes into mechanical contact with the at least one first door leaf 2*a* or comes into mechanical contact with a locking bolt 38. As a result, the lever device 141 is caused to pivot and/or to snap around, causing the movable sealing device 140 to be movable from the first position into the second position (evenly or jerkily). The second lever arm 143 may also for example be arranged in the at least one first guide groove 15. In this case, said arm comes into contact with the engagement element 11, in particular in the form of the guide blade of the at least one first door leaf 2*a*.

The displacement device 141 is preferably formed in such a way that, in the absence of mechanical contact on the second end 143*b* of the second lever arm 143, the lever device 141 pivots (back) and/or snaps back or snaps around, causing the movable sealing device 140 to be movable from the second position into the first position. This preferably takes place by way of a spring device 144 or merely under gravity.

Figure 10A:
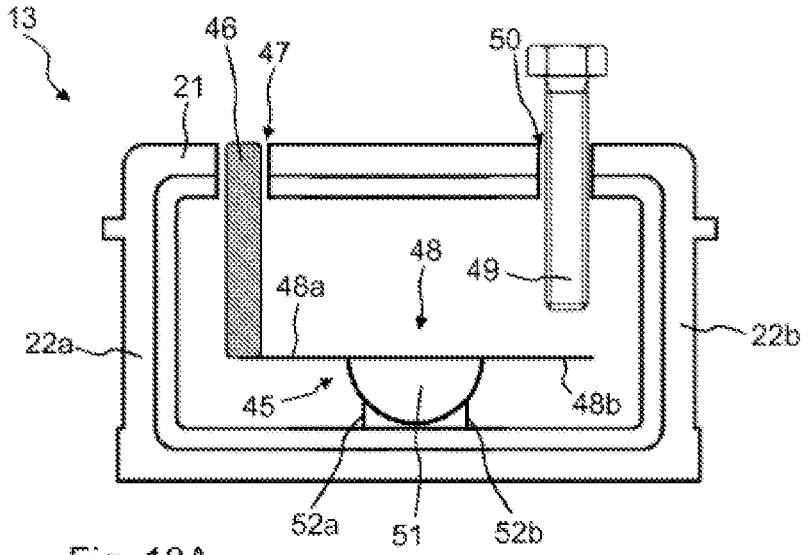
FIG. 10A, 10B, 10C, 10D show two different solutions for a levelling device within the connection and/or functional element.
Figure 10B:
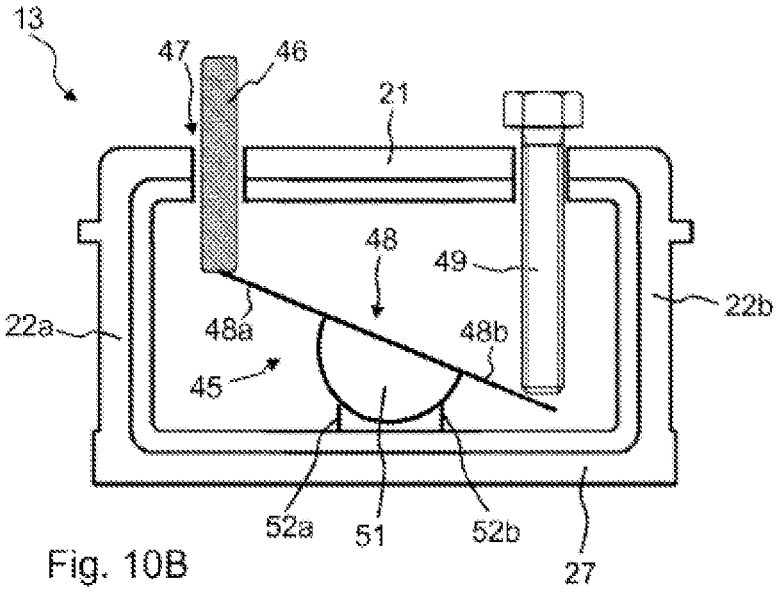

FIGS. 10A and 10B describe a further function of the at least one connection and/or functional element 13. It comprises at least one levelling device 45, which in turn is arranged predominantly or completely within the cavity 19 of the at least one connection and/or functional element 13. The levelling device 45 comprises a displaceably arranged lifting element 46, in particular in the form of a bolt 46, which protrudes or can protrude from a first opening 47 in the upper wall segment 21. The levelling device 45 moreover comprises an actuation device, which is formed to push the bolt 46 different distances out of the first opening 47, a lower face of a door structure, such as a doorframe 31 or glass frame, being positioned on the bolt 46. This door structure is or can be inclined to different extents depending on the position of the bolt 46. In particular, this door structure is inclined to a greater extent the further the bolt 46 protrudes from the opening 47. This inclination takes place along the longitudinal direction 6.

The levelling device 45 or a further levelling device may also be arranged in the first and/or second floor rail 10*a*, 10*b* of the at least one first floor rail arrangement 10.

There may also be two levelling devices 45 provided in the at least one first floor rail arrangement 10. In this case, a distance of the door structure from the at least one first floor rail arrangement 10 can be changed. A height adjustment of the door structure is thus additionally possible.

To push the bolt 46 out of the opening, the actuation device is required, which comprises a rocker 48 having two lever arms 48*a*, 48*b*. The rocker 48 is preferably arranged completely within the connection and/or functional element 13. In this case, the bolt 46 is positioned on the first lever arm 48*a*. A screw 49 or engagement element 49 can be screwed into the connection and/or functional element 13 from outside the connection and/or functional element 13 via a second opening 50 in the upper wall segment 21. In this context, one end of the screw 49 or engagement element 49 can be brought into contact with the second lever arm 48*b* of the rocker 48. In this context, the second opening 50 is not overlapped by the door structure. The rocker 48 along with the two lever arms 48*a*, 48*b* thereof is mounted tiltable or inclinable about the rocker axis thereof in the connection and/or functional element 13. In the embodiment shown, the rocker 48 further comprises a mounting segment 51, which is hemispherical in cross section and can be mounted between two carriers 52*a*, 52*b* and accordingly rotated. The further the screw 49 or engagement element 49 is introduced, in particular screwed, into the second opening 50, the further the second lever arm 48*b* of the rocker 48 is pushed towards the floor, in particular towards the lower wall segment 27. Consequently, the first lever arm 48*a* is pushed closer towards the first opening 47. As a result, the bolt 46 is pushed further out of the opening 47. In this context, the first screw 49 can be screwed in particular into a thread in the second opening 50 of the upper wall segment 21, in such a way that the inherent weight of the door structure that lies on the bolt 46 does not lead to the screw 49 being able to be pushed out of the second opening 50 again.

In this case too, the connection and/or functional element 13 may already be equipped with the corresponding levelling device 45 during production.

Figure 10C:
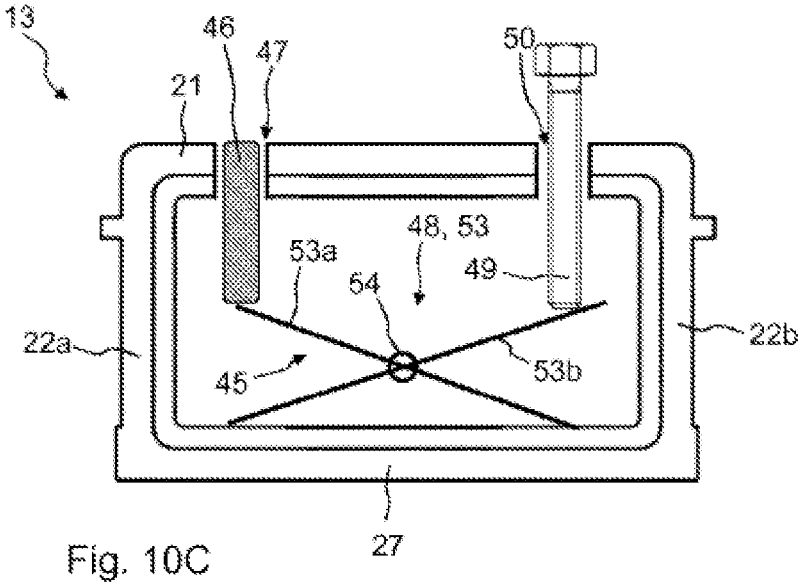
Figure 10D:
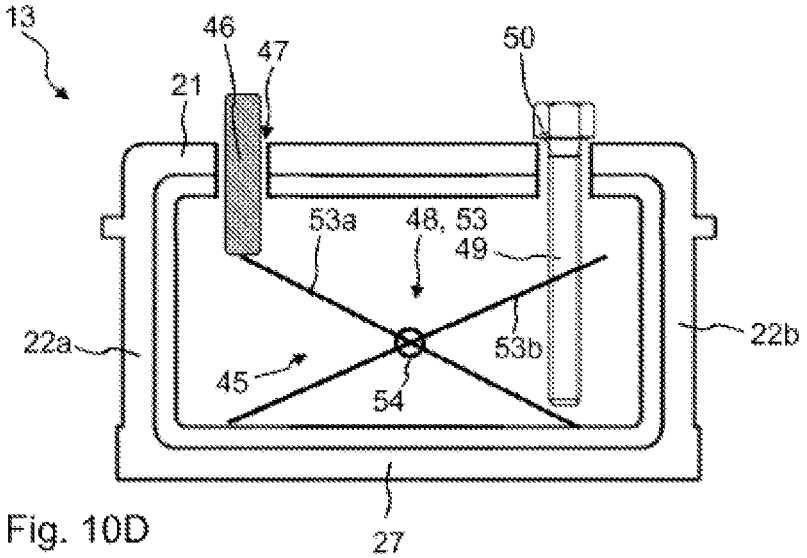

FIGS. 10C and 10D show a different construction of the levelling device 45. The actuation device 48 comprises a scissor frame 53 comprising a first scissor arm 53*a* and a second scissor arm 53*b*, which are articulated to one another via an articulated connection 54 in the region of the centre thereof. The wording "in the region of the centre thereof" includes deviations of less than 5 cm, 4 cm, 3 cm, 2 cm or 1 cm from the centre point of the scissor arms 53*a*, 53*b*. The scissor frame 53 is arranged within the connection and/or functional element 13. The bolt 46 is positioned on the first end of the first scissor arm 53*a*. A screw 49 can be screwed into the connection and/or functional element 13 from outside the connection and/or functional element 13 via a second opening 50 in the upper wall segment 21, 16, an end of the screw 49 passing through an opening in a first end of the second scissor arm 53*b*, which comprises an internal thread. The two second ends of the two scissor arms 53*a*, 53*b* are braced on a lower wall segment 27, 18. The bolt 46 is pushed further out of the first opening 47 the further the screw 49 is screwed through the opening in the first end of the second scissor arm 53*b* and is in contact with the second end of the first scissor arm 53*a*.

The levelling device 45 or a further levelling device may also be arranged in the first and/or second floor rail 10*a*, 10*b* of the at least one first floor rail arrangement 10.

The at least one connection and/or functional element 13 may also comprise further additional functions. Thus, a heating element, in particular in the form of a heating wire, may be arranged therein. It is moreover possible for the at least one first drive device in the form of an electric motor to be arranged in the at least one connection and/or functional element 13. The same may also additionally or alternatively apply to a spindle that displaces the at least one first door leaf 2*a* along the longitudinal direction 6. Power and/or data cables may also be arranged within the at least one connection and/or functional element 13. For this purpose, corresponding plug-in connections may also be provided. A control device, which comprises for example a circuit board and/or a corresponding housing, may also be arranged within the at least one connection and/or functional element 13. The same may also apply to a sensor device that monitors the region around the at least one first door leaf 2*a*. This may include radar sensors, IR sensors, light barriers and/or ultrasound sensors. In this context, the sensor device may monitor the primary closing edge and/or the secondary closing edge. An LED device may also be provided. This may also include a screen device. The same also applies to a loudspeaker device.

Preferably, the upper wall segment 21 of the at least one connection and/or functional element 13 is closed. It would also be possible for drainage openings 55 (FIG. 3B) also to be introduced so as to guide water into a carrier profile 60 arranged below the at least one floor rail arrangement 10. The carrier profile 60 is described in greater detail below. In the embodiment, these drainage openings 55 are introduced in the groove base 15*a* of the first guide groove 15. In principle, it would also be possible for the connection and/or functional element 13 to be configured free of a first guide groove 15, in which case the upper wall segment 21 would be passed through by the drainage openings 55.

The features set out here may also be introduced to the first floor rail 10*a* and/or to the at least one second floor rail 10*b*. This also applies in particular to the drainage openings 55. Thus, it would be possible for the first or second floor rail 10*a*, 10*b* to be open towards the floor, in other words towards the carrier profile 60, the drainage openings 55 being introduced at the corresponding upper wall segments 16.

Figure 7A:
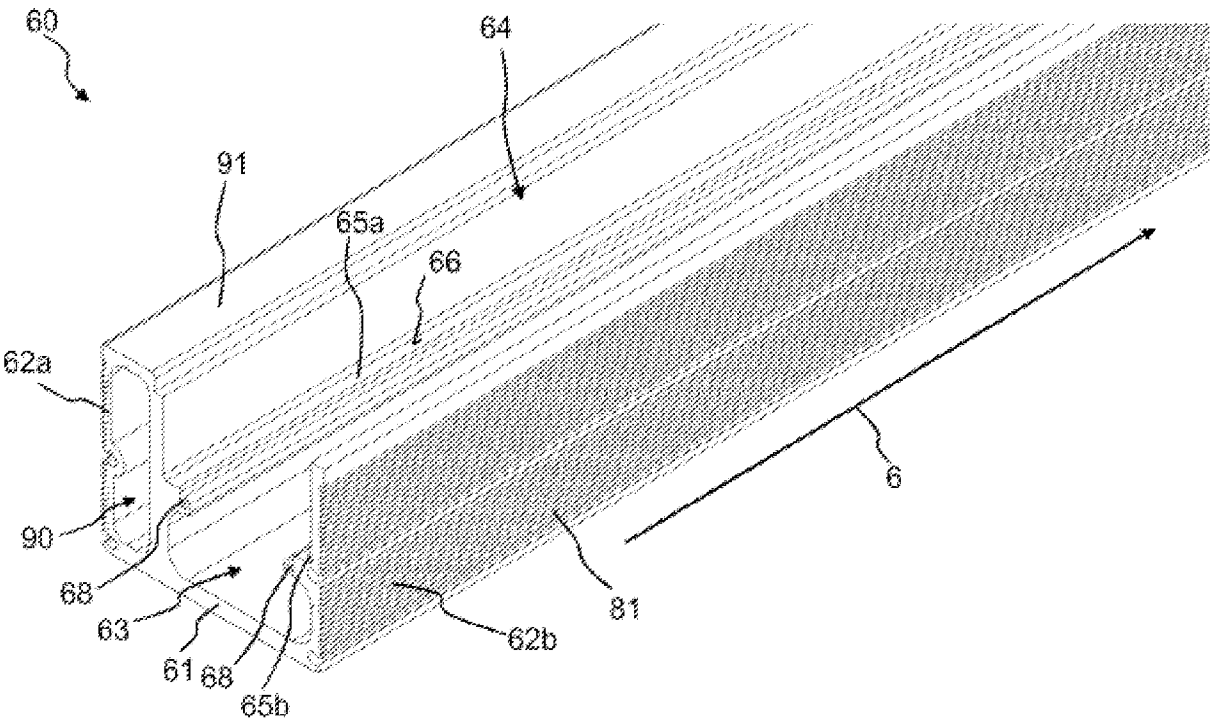
FIG. 7A to 7C are various views of a carrier profile.

FIG. 7A shows that the floor-side guide rail arrangement 9 further comprises the at least one carrier profile 60. This carrier profile 60 extends in the longitudinal direction 6, and is arrangeable or arranged in a recess in the floor. The carrier profile 60 is optional. In principle, the first floor rail arrangement 10, comprising the at least one first floor rail 10*a* and optionally the at least one second floor rail 10*b* and the connection and/or functional element 13, could also be arranged directly on the floor and screwed thereto. In this context, the floor is in particular a concrete floor.

The at least one carrier profile 60 comprises a base wall 61 and side walls 62*a*, 62*b*, which extend away from the base wall 61 and together enclose a receiving space 63. The receiving space 63 is accessible via an upper face 64 of the at least one carrier profile 60. The upper face 64 is arranged closer than the base wall 61 of the carrier profile 60 to a lower face 12 of the at least one first door leaf 2*a*.

The carrier profile 60 preferably consists of an extrusion and is also preferably formed from metal, in particular aluminium.

The carrier profile 60 comprises at least two support regions 65*a*, 65*b*, which are spaced apart from one another, each support region 65*a*, 65*b* being arranged between the upper face 64 and the base wall 61 and spaced apart from these two elements. The support regions 65*a*, 65*b* extend at least along a particular length in the longitudinal direction 6. Preferably, these two support regions 65*a*, 65*b* extend a distance in the longitudinal direction 6 equal to the length of the carrier profile 60, since as a result manufacture by extrusion moulding is possible. Nevertheless, interruptions may also be present.

In this context, the at least one first floor rail arrangement 10 is in each case positioned on an upper support face 66, facing towards the at least one first door leaf 2*a*, of the support regions 65*a*, 65*b*.

In principle, the base wall 61 could also serve as a support region. In this case, the at least one first floor rail arrangement 10 is positioned directly on the base wall 61.

This means that the carrier profile 60 extends a distance in the longitudinal direction 6 equal to the length of the at least one first floor rail arrangement 10. As explained previously, the first floor rail arrangement 10 preferably comprises the two floor rails 10*a*, 10*b* and the connection and/or functional element 13. The first floor rail arrangement 10 may thus be preassembled, in which case it is supported as a whole on the corresponding support faces 66 of the support regions 65*a*, 65*b*.

Figure 7C:
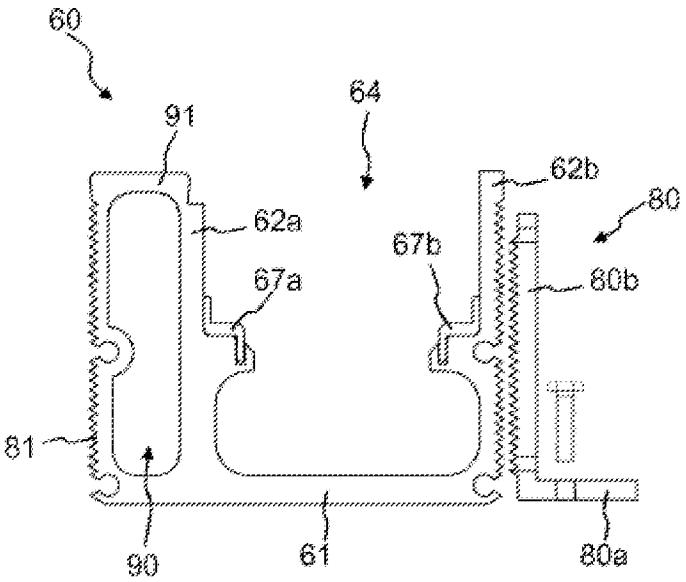
Figure 8:
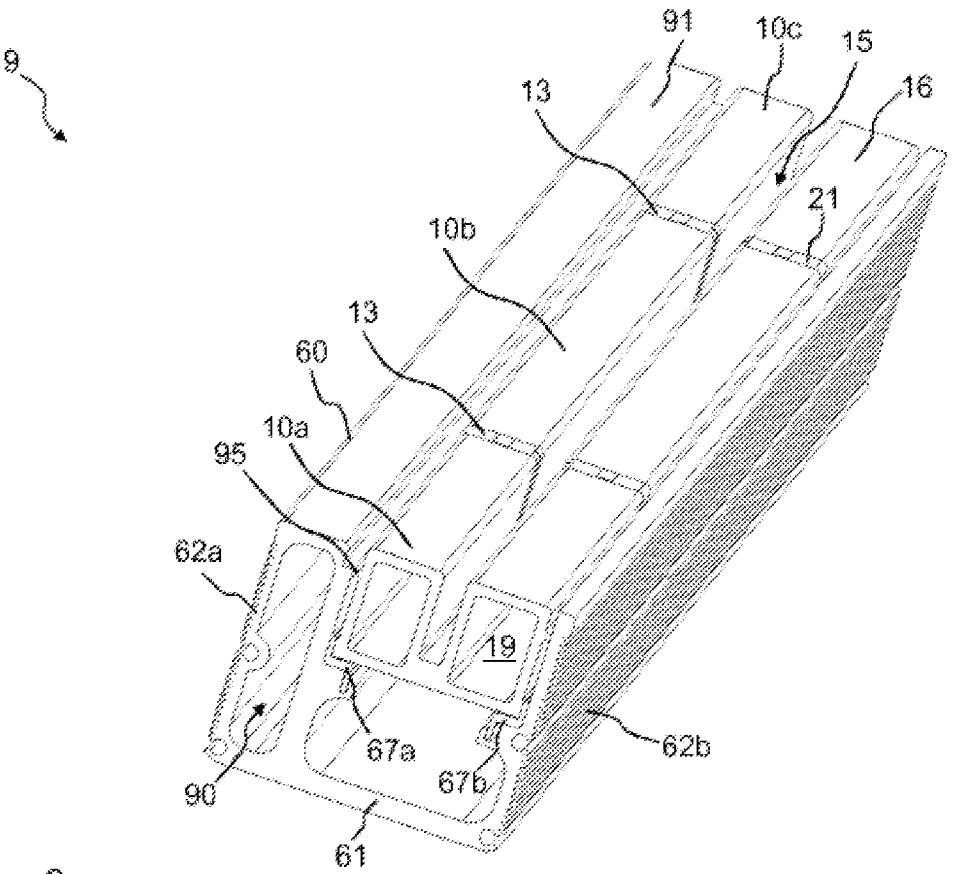
FIG. 8 is a three-dimensional view of a floor-side guide rail arrangement.

This state of affairs is shown in FIG. 8. FIG. 8, and likewise FIG. 7C, also show that, for better thermal decoupling, a dielectric insulating element 67*a*, 67*b* is further arranged in each case between the at least one first floor rail arrangement 10 and the upper support face 66 of the first support region 65*a* and the second support region 65*b*. This dielectric insulating element 67*a*, 67*b* is in particular formed hook-shaped, and also comprises a support face, on which the at least one first floor rail arrangement 10 is ultimately positioned. This first or second dielectric insulating element 67*a*, 67*b* preferably consists of or comprises plastics material. It further preferably extends along the entire length of the corresponding support region 65*a*, 65*b*. It would also be possible for the associated dielectric insulating element 67*a*, 67*b* only to extend along the longitudinal direction 6 over a sub-length of the associated support region 65*a*, 65*b*. The dielectric insulating elements 67*a*, 67*b* have in particular a lower thermal conductivity than the at least one first floor rail arrangement 10 and the at least one carrier profile 60.

Instead of the dielectric insulating elements 67*a*, 67*b*, a dielectric insulating plate could also be used. This would then be positioned jointly on both support regions 65*a*, 65*b*. It could further have openings for drainage.

So as to be able to fix the associated dielectric insulating element 67*a*, 67*b* securely, the first support region 65*a* comprises an engagement groove 68 (see FIG. 7A, 7B) extending in the longitudinal direction 6. The same also applies to the second support region 65*b*. The associated dielectric insulating element 67*a*, 67*b* is inserted into these engagement grooves 68. The dielectric insulating elements 67*a*, 67*b* are preferably formed hook-shaped, in such a way that one end is arranged in the associated engagement groove 68 and the other end is positioned on an inner wall of the corresponding side wall 62*a*, 62*b*. As well as a hook shape, the dielectric insulating element 67*a*, 67*b* could also be configured Z-shaped.

Figure 9B:
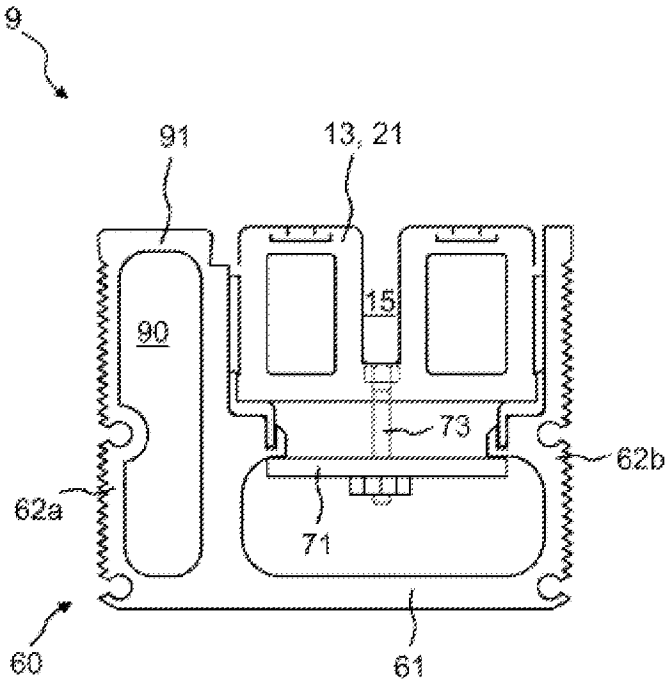
FIG. 9A, 9B are a cross section through the guide rail arrangement, illustrating how the connection and/or functional element is fixed.
Figure 9A:
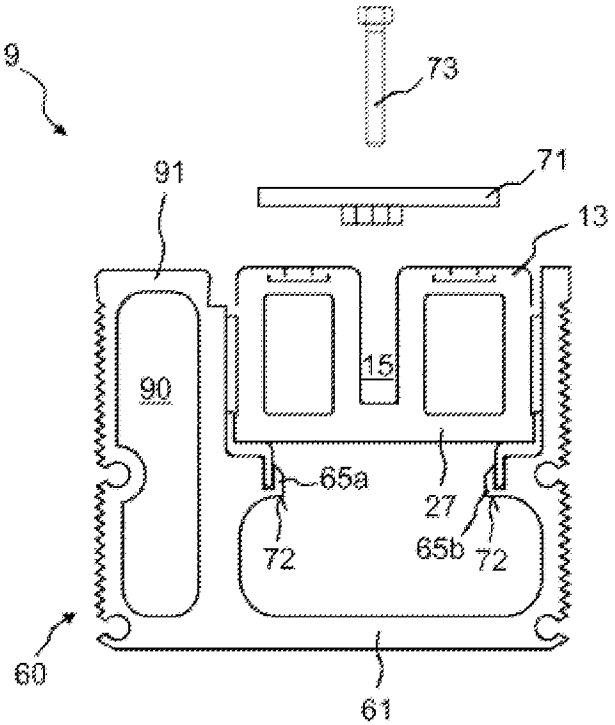

To ensure that the first floor rail arrangement 10, comprising the at least one first and/or the at least one second floor rail 10*a*, 10*b* and the at least one connection and/or functional element 13, cannot be lifted from the carrier profile 60, the at least one connection and/or functional element 13 preferably further comprises corresponding fixing means. These are in particular a continuous arresting opening 70 (see FIG. 3B) and a contact pressure element 71. In this connection, reference is made to FIGS. 9A and 9B. The contact pressure element 71, which in the simplest case is a piece of metal or plastics material in which an opening is introduced, is arranged on a lower support face 72, facing towards the base wall 61 of the carrier profile 60, of the associated first or second support region 65*a*, 65*b* during the assembly of the at least one connection and/or functional element 13. A screw connection 73 passes through the arresting opening 70 of the at least one connection and/or functional element 13. The screw connection 73 likewise passes through the contact pressure element 71. The opening of the contact pressure element 71, which is passed through by the screw connection 73, may have a thread or be formed threadless. In the latter case, a nut, which is shown in FIG. 9A, is further required. The screw connection 73 is arranged on the at least one connection and/or functional element 13 and the contact pressure element 71 in such a way that when the screw connection 73 is tightened a distance between the at least one connection and/or functional element 13 and the contact pressure element 71 is reduced. As a result, the at least one connection and/or functional element 13 is pushed onto the upper support faces 66 of the two support regions 65*a*, 65*b*, and the contact pressure element 71 is pushed onto the lower support faces 72 of the two support regions 65*a*, 65*b*. As a result, the at least one connection and/or functional element 13 is prevented from lifting away from the at least one carrier profile 60. The screw head of the screw connection 73 dips in particular into a corresponding depression in the groove base 15 of the connection and/or functional element 13. As a result, the at least one first guide groove 15 is free of obstacles, and the corresponding engagement element 11, such as the guide blade, can be displaced back and forth within the at least one first guide groove 15 without difficulty.

The side walls 62*a*, 62*b* of the at least one carrier profile 60 end in particular flush with the at least one first floor rail arrangement 10 at the upper face 64. The wording "approximately" should be understood to mean that a height difference between the upper region of the carrier profile 60 and the corresponding upper wall segment 16 or 21 of the first or second floor rail 10*a*, 10*b* and/or the at least one connection and/or functional element 13 is less than 7 mm, 6 mm, 5 mm, 4 mm, 3 mm or 2 mm.

Figure 13A:
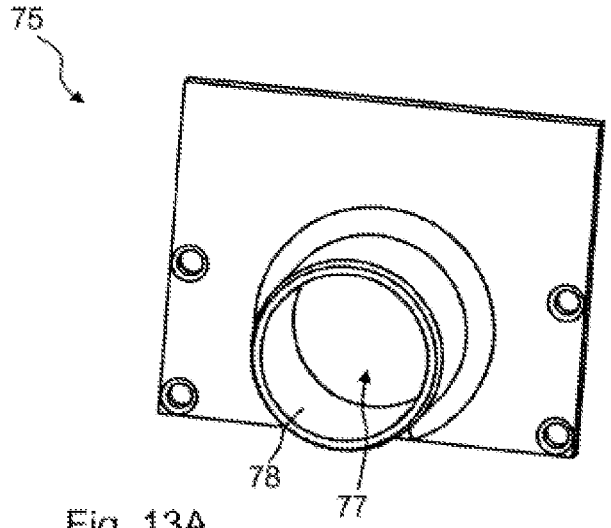
FIG. 13A, 13B show an option for achieving drainage of the guide rail arrangement.
Figure 13B:
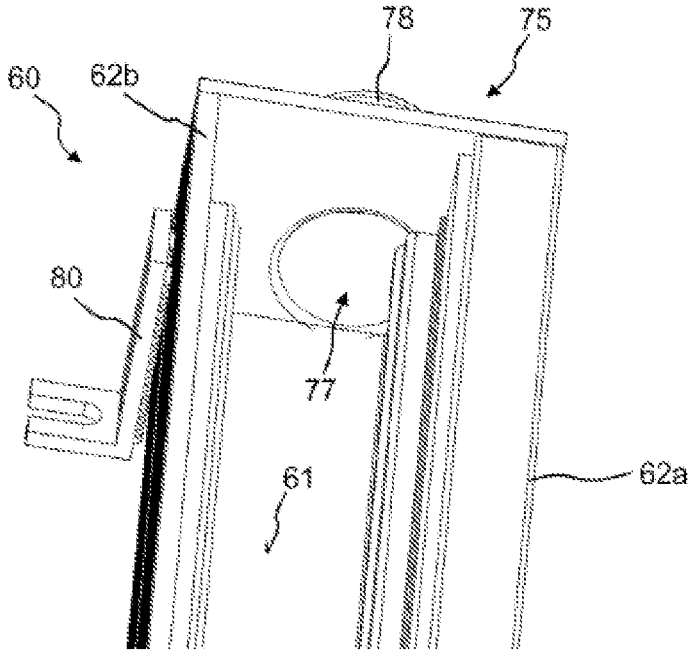

FIGS. 1, 13*a* and 13*b* show that the end faces of the at least one carrier profile 60 are closed by end walls 75, 76. At least one end wall 75 comprises, in the region of the base wall 61 of the carrier profile 60, an opening 77 comprising a tubular projection 78. The tubular projection 78 serves to connect to a drainage pipe or drainage hose. The other end face 76 is preferably free of openings. Rainwater that flows through the at least one first floor rail arrangement 10 through the already shown drainage openings 55 is collected by the base wall 61 of the carrier profile 60 and discharged through the opening 77. The opening 77 comprising the tubular projection 78 may also be introduced in the base wall 61 or in at least one side wall 62*a*, 62*b* of the carrier profile 60.

As explained previously, the carrier profile 60 is fixed in a recess in the floor. In this context, a distance of the carrier profile 60 from the floor is variable. This variable distance is set using bracing brackets 80, such as are shown by way of example in FIGS. 7B and 7C. The side walls 62*a*, 62*b* of the carrier profile 60 comprise, on the outer face thereof, a plurality of holding notches 81, which are spaced apart from one another along the height of the side walls 62, 62*b*. These holding notches 81 extend in the longitudinal direction. The bracing brackets 80 are in particular formed L-shaped in cross section. The bracing brackets 80 therefore comprise a foot element 80*a*, which is in particular passed through by an opening. This foot element 80*a* is screwed to the floor. On an engagement face 80*b*, which extends transverse, in particular perpendicular, to the foot element 80*a*, a plurality of holding projections 82 are arranged, which correspond to the holding notches 81. The holding projections 82 of the bracing brackets 80 engage in one or more of the holding notches 81 in each case, a distance between the at least one carrier profile 80 and a base structure being adjustable depending on the holding notches 81 in which the projections 82 of the bracing brackets 80 engage. In FIG. 7B, the distance of the carrier profile 80 from the floor (not shown) is greater than in FIG. 7C, where the carrier profile 60 is positioned directly on the floor.

In particular, a plurality of bracing brackets 80 mutually offset in the longitudinal direction 6 are used, which are arranged on both side walls 62*a*, 62*b* of the carrier profile 60 and engage in the holding notches 81 arranged there. In this context, each bracing bracket 80 can engage in different holding notches 81, in other words be spaced a different distance apart from an upper face 64 of the carrier profile 60. As a result, it is possible for the carrier profile 60 to be orientated horizontally even in the event of uneven floor conditions.

Preferably, however, the distance of the carrier profile 60 from a floor structure is altered in that the bracing brackets 80 have a slot, a screw connection engaging in the associated fixing opening in the carrier profile 60 through the slot. As a result, the associated bracing bracket 80 is fixed on the carrier profile 60. A distance between the at least one carrier profile 60 and the floor structure is adjustable depending on the position at which the screw connection passes through the slot of the associated bracing bracket 80. In this context, the slot is introduced in the part of the bracing bracket 80 that preferably extends parallel to the side walls 62*a*, 62*b* of the carrier profile 60. The slot may further additionally be open from one side. The fixing openings may fully pass through the associated side wall 62*a*, 62*b* or end therein. They in particular comprise an internal thread.

Figure 7B:
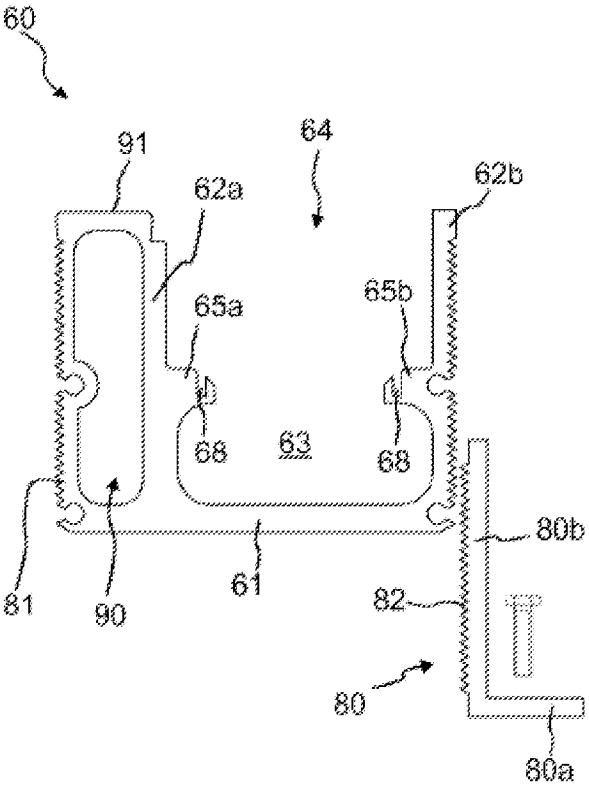

Referring to FIGS. 7B and 7C, the carrier profile 60 further comprises an additional receiving space 90, which connects to the first or second side wall 62*a*, 62*b* and is predominantly closed in cross section. An upper wall 91 of the additional receiving space 90 is preferably formed to hold a door structure such as a doorframe 31 or glass frame. This upper wall 91 of the additional receiving space 90 may likewise be provided with a holding device, for example in the form of a casing such as is shown for example in FIG. 12 for the connection and/or functional element 13. In principle, the upper wall 91 could also further have corresponding fixing openings.

The carrier profile 60, which is shown for example in FIGS. 7A to 7C and 8, is U-shaped in cross section. The first support region 65*a* is formed as a support shoulder on the first side wall 62*a*, and protrudes into the receiving space 63. The fact that the first side wall 62*a* is passed through by the additional receiving space 90 in no way alters the fact that the first receiving region 65*a* is still formed on the first side wall 62*a*. In this context, the first support region 65*a* is thus formed in a single piece on the first side wall 62*a*. The same also applies to the second support region 65*b*, which is formed as a support shoulder on the second side wall 62*b* and protrudes into the shared receiving space 63. The at least one carrier profile 60 is preferably formed in a single piece.

Referring to FIGS. 2, 4 and 8, it is moreover shown that the first floor rail arrangement 10 further has, on the lateral wall segments 17*a*, 17*b* thereof, a projection 95 extending in the longitudinal direction 6. This projection 95 lies flush on the side walls 62*a*, 62*b* of the carrier profile 60, and prevents soiling of the receiving frame 63.

A transition between the upper wall segment 16, 21 and the lateral wall segments 17*a*, 17*b* and 22*a*, 22*b* is preferably bevelled. This bevel serves to guide sealing elements 100, in particular in the form of a strip brush, such as are shown for example in FIG. 15. The at least one first door leaf 2*a* of the at least one first door leaf arrangement 2 comprises these sealing elements 100. These are arranged at least on a face alongside the engagement element 11, and extend (predominantly) parallel and/or transverse to the engagement element 11 of the first door leaf 2*a* and extend from the lower face 12 of the at least one first door leaf 2*a* towards the upper wall segment 16, 21 of the first floor rail 10*a* and/or second floor rail 10*b* and/or connection and/or functional element 13 of the first floor rail arrangement 10. Because the transition region is configured inclined, mechanical strain does not occur even if the sealing elements 100 extend along the entire length of the at least one first door leaf 2*a* and the first door leaf 2*a* changes its movement direction. If these sealing elements 100 converged directly perpendicular to the upper wall segment 16, 21 and touched it, high forces might be required in order for the movement direction of the first door leaf 2*a* to change. Instead, only a side region, and not the end face, of the sealing elements 100 lies against a bevelled transition between the upper wall segment 16, 21 and the associated lateral wall segment 17*a*, 17*b*, 22*a*, 22*b*. In particular, the ends of the sealing elements 100 are arranged contact-free or predominantly contact-free with respect to the upper wall segments 16, 21 of the first floor rail 10*a* and/or the second floor rail 10*b* and/or the connection and/or functional element 13, or do not even touch this.

Moreover, FIG. 8 shows that the first floor rail arrangement 10 comprises three floor rails 10*a*, 10*b*, 10*c*, which are each interconnected at the end faces 14 thereof via a connection and/or functional element 13. In this case, there are also two connection and/or functional elements 13 in the first floor rail arrangement 10. These may be identical or different in construction, so as to be able to perform different functions.

Figure 16:
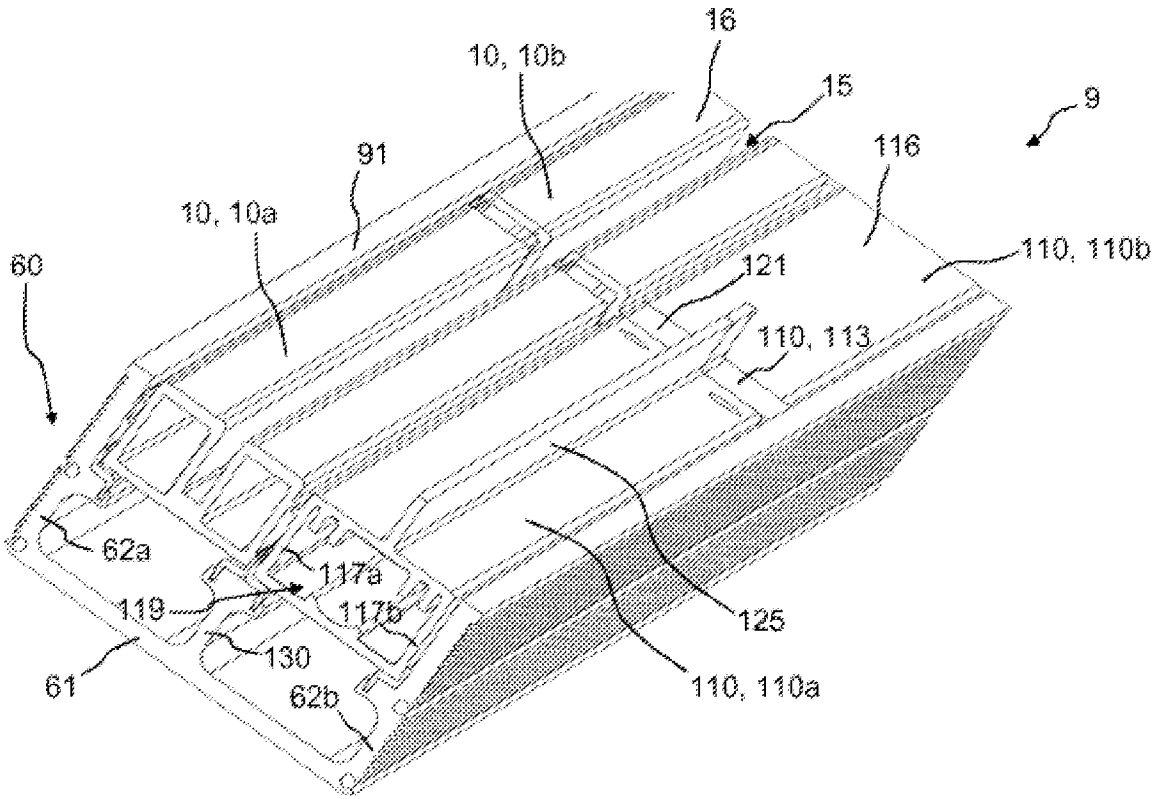
FIGS. 16 and 17 are different three-dimensional drawings of the floor-side guide rail arrangement comprising the further carrier profile.
Figure 17:
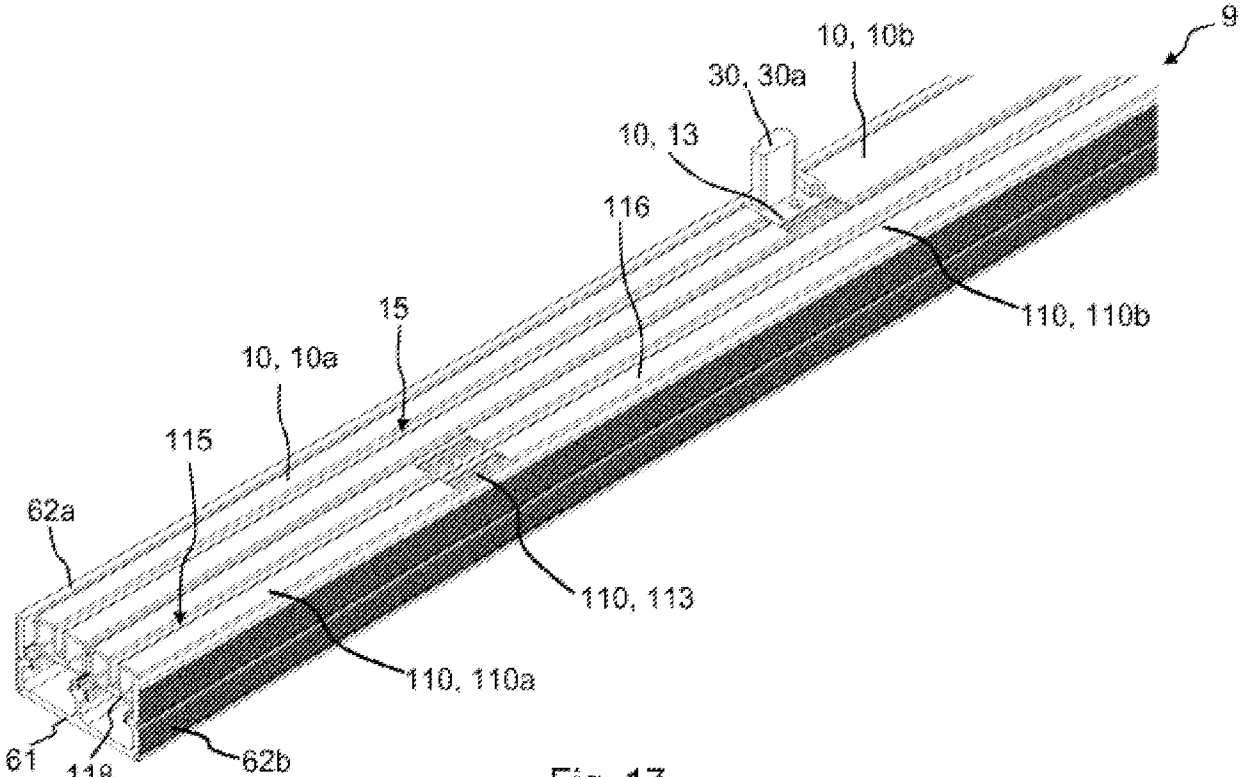

FIGS. 16 and 17 further show that the floor-side guide rail arrangement 9 comprises at least one second floor rail arrangement 110, which has at least one second guide groove 115 (FIG. 17), which extends parallel to the first floor rail arrangement 10. The second guide groove 115 likewise extends in the longitudinal direction 6 and extends parallel to the first guide groove 15. In this case, the at least one first door leaf arrangement 2 comprises a second door leaf (not shown), which in turn comprises an engagement element arranged on the lower face thereof. In this case, the at least one engagement element of the at least one second door leaf of the at least one first door leaf arrangement 2 dips into the at least one second guide groove 115, and is guided in the longitudinal direction 6 by the at least one second guide groove 115. The at least one second floor rail arrangement 110 comprises at least one first floor rail 110*a* and at least one connection and/or functional element 113, the at least one connection and/or functional element 113 being arranged and/or fixed on an end face of the at least one first floor rail 110*a* and thus lengthening the first floor rail 110*a* in the longitudinal direction 6. In this case, the at least one first door leaf arrangement 2 is formed as a telescopic sliding door, the at least one first door leaf 2*a* and the at least one second door leaf being formed as sliding door leaves that extend mutually parallel in different guide grooves 15, 115 and along stages of different length. The at least one second door leaf could also be arranged stationary. In this case, it would be rigidly connected to the second floor rail arrangement 110 and in particular rigidly connected to the connection and/or functional element 113 of the second floor rail arrangement 110. In this case, it can also be said that the second floor rail arrangement 110 carries or holds part of the door structure.

FIG. 17 shows that the at least one second floor rail arrangement 110 further comprises at least one second floor rail 110*b*, which extends in the longitudinal direction 6. The first and second floor rail 110*a*, 110*b* of the at least one second floor rail arrangement 110 each comprise an upper wall segment 116 and two lateral wall segments 117*a*, 117*b* (see FIG. 16), which connect to the upper wall segment 116 and together enclose a cavity 119 extending in the longitudinal direction 6, the first and/or second floor rail 110*a*, 110*b* being closed in cross section in the peripheral direction by a lower wall segment 118 (see FIG. 17), which is adjacent to the two wall segments 117*a*, 17*b*. It could also be the case that the first and/or second floor rail 110*a*, 110*b* is open at least in portions towards the floor or towards the carrier profile 60. The first and second floor rail 110*a*, 110*b* have on the end faces thereof an engagement opening, through which the cavity 119 is accessible. The at least one connection and/or functional element 113 of the second floor rail arrangement 110 comprises at least one upper wall segment 121 and two lateral wall segments that connect to the upper wall segment 121. The at least one connection and/or functional element 113 of the second floor rail arrangement 110 is arranged between first end faces, facing towards one another, of the two floor rails 110*a*, 110*b*, the second floor rail 110*b* of the at least one second floor rail arrangement 110 preferably being free of the second guide groove 115.

FIG. 16 shows that the second floor rail arrangement 110 does not actually have any guide grooves. The second floor rail 110*b* is formed planar and fully closed in the region of the upper wall segment 116 thereof, whereas the first floor rail 110*a* is likewise formed free of the second guide groove 115 and instead has a guide web 125, which extends from the upper wall segment 16 towards a door structure (not shown).

By contrast, FIG. 17 also shows the second guide groove 115. In the embodiment, the first guide groove 15 and the at least one second guide groove 115 are of different length.

Figure 14:
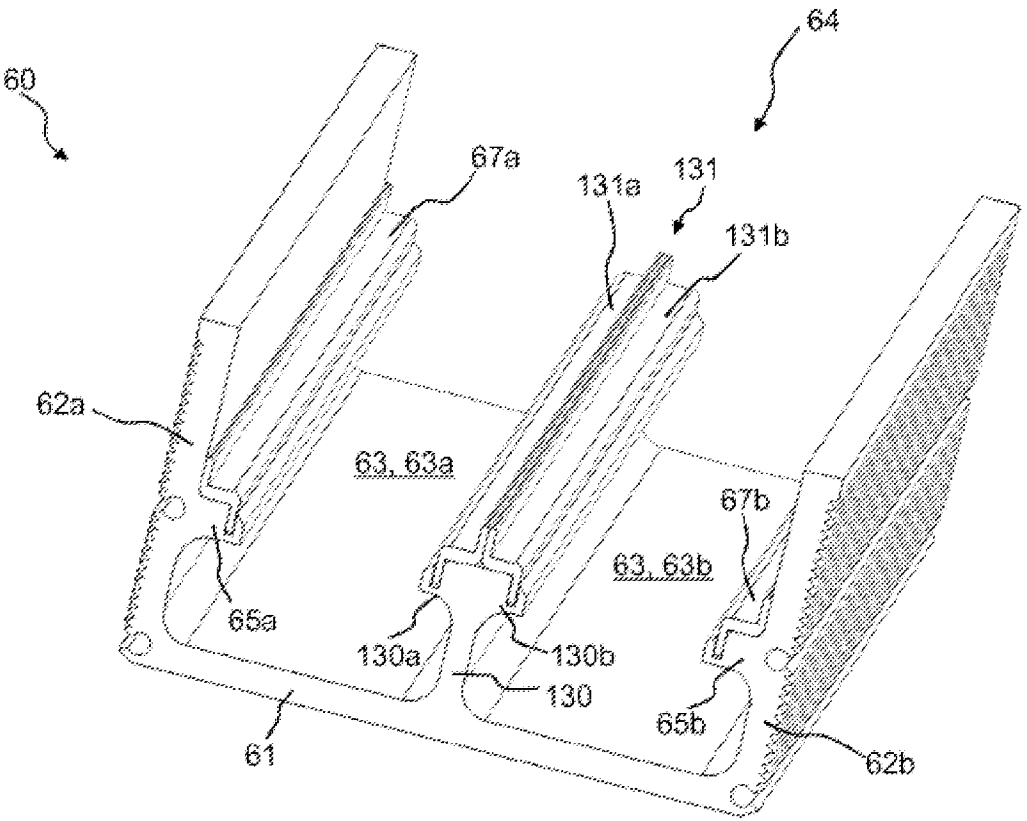
FIG. 14 is a three-dimensional view of a further carrier profile.

The first floor rail arrangement 10 and the second floor rail arrangement 110 can be introduced directly into a receiving opening in the base of the door structure. However, it is also possible for them to be laid in the carrier profile 60 and connected thereto. A further carrier profile 60 of this type can be seen in particular in FIG. 14. It is constructed like the previously described carrier profile 60, and comprises side walls 62*a*, 62*b* that extend away from the base wall 61 and enclose the shared receiving space 63. In addition, a separating web 130 is further provided here, and protrudes out from the base wall 61 towards the upper face 64 between the two side walls 62*a*, 62*b*. The separating web 130 is preferably of a lower height than the side walls 62*a*, 62*b*. However, this need not necessarily be the case; it could also be of the same height.

Preferably, the separating web 130 widens towards the open end thereof. The separating web 130 also extends in the longitudinal direction 6, and subdivides the receiving space 63 into a first and a second receiving chamber 63*a*, 63*b*. The at least one separating web 130 comprises further support regions 130*a*, 130*b*, which extend in the longitudinal direction 6. One of these further support regions 130*a* is formed as a support shoulder, and protrudes out from the separating web 130 into the first receiving chamber 63*a*, whereas another support region 130*b* is formed as a support shoulder and protrudes from the separating web 130 into the second receiving chamber 63*b*.

The first floor rail arrangement 10 and the second floor rail arrangement 110 are positioned on these support regions 130*a*, 130*b* and 65*a*, 65*b*.

In the first receiving chamber 63*a*, the support region may also be formed by the base wall 61. The same may also apply to the support region in the second receiving chamber 63*b*. In this case, the floor rail arrangements 10, 110 would be positioned directly on the associated support regions of the base wall 61.

Preferably, there is at least one further dielectric insulating element 131, which is formed bracket-shaped and is positioned on the further support regions 130*a*, 130*b* of the at least one separating web 130 and encloses an upper face of the at least one separating web 130. This further dielectric insulating element 131 may extend along the longitudinal direction 6 over the entire length over which the further support regions 130*a*, 130*b* also extend. However, it may also merely extend over a sub-length.

The further support regions 130*a*, 130*b* also in turn comprise engagement grooves, in which the further dielectric insulating element 131 engages.

Preferably, the further dielectric insulating element 131 is constructed divided in two and comprises two mutually separated dielectric insulating elements 131*a* and 131*b*, which are formed hook-shaped or Z-shaped and are preferably constructed identically, in terms of the cross section thereof, to the already known dielectric insulating elements 67*a*, 67*b*, in such a way that merely one type of dielectric insulating element 67*a*, 67*b*, 131*a*, 131*b* has to be produced. Because the dielectric insulating elements 67*a*, 67*b*, 131*a*, 131*b* preferably consist of plastics material, it is sufficient if merely one injection mould is manufactured. An extrusion moulding method would also be suitable for manufacturing them.

The fixing of the associated connection and/or functional elements 13, 113 preferably takes place, as stated previously, on the carrier profile 60. As explained previously, drainage is also possible.

Further separating webs 130 could also be provided, in such a way that further floor rail arrangements can also be received.

The at least one connection and/or functional element 13 of the at least one first floor rail arrangement 10 has a worse, in other words lesser or lower thermal conductivity than the at least one first floor rail 10*a* and the at least one second floor rail 10*b* of the at least one first floor rail arrangement 10. The same also applies to the connection and/or functional element 113 of the second floor rail arrangement 110 in relation to the first and second floor rails 110*a*, 110*b* therein.

The embodiments set out here, which have been explained in particular for the first door leaf 2*a* of the first door leaf arrangement 2, also apply to the second and further door leaves 3*a* of the first door leaf arrangement 2 and second door leaf arrangement 3.

The statements made for the first floor rail arrangement 10 also apply as a whole to the second floor rail arrangement 110 and to arbitrarily many further floor rail arrangements.

The connection and/or functional element 13, 113 may also be referred to as a connection and/or functional rail 13, 113.

The automatic door system 1 preferably comprises the following feature:

the engagement element 11 comprises a guide blade, the guide blade being arranged on the lower face 12 of the at least one first door leaf 2*a*, which is in the form of a sliding door leaf; or the engagement element 11 comprises a guide bolt, the guide bolt being arranged on the lower face 12 of the at least one first door leaf 2*a*, which is in the form of a folding door leaf.

The automatic door system 1 preferably comprises the following features:

the first floor rail 10*a* and/or the second floor rail 10*b* of the first floor rail arrangement 10:

a) consist of metal; or b) consist of plastics material or comprise plastics material; and/or the at least one connection and/or functional element 13 consists of or comprises:

a) metal; or b) plastics material.

The automatic door system 1 preferably comprises the following features:

at least the upper wall segment 16 of the first floor rail 10*a* and/or second floor rail 10*b* of the first floor rail arrangement 10 is platinum-plated, along the entire length of the associated floor rail 10*a*, 10*b* or along a sub-length, at least with a metal sheet that is adapted to the progression of the upper wall segment 16; and/or at least the upper wall segment 21 of the at least one connection and/or functional element 13 of the first floor rail arrangement 10 is platinum-plated with a metal sheet that is adapted to the progression of the upper wall segment 21.

The automatic door system 1 preferably comprises the following features:

the at least one connection and/or functional element 13 comprises, on each of the first and the second end face 24, 25 thereof, a fixing projection 26;

the fixing projection 26 on the first end face 24 of the at least one connection and/or functional element 13 engages in the engagement opening 23 on the first end face 14 of the first floor rail 10*a*, and the fixing projection 26 on the second end face 25 of the at least one connection and/or functional element 13 engages in the engagement opening 23 on the first end face 14 of the second floor rail 10*b*.

The automatic door system 1 preferably comprises the following features:

the floor-side guide rail arrangement 9 further comprises a sealing device;

the sealing device is arranged between the at least one connection and/or functional element 13 and the associated first and second floor rail 10*a*, 10*b*.

The automatic door system 1 preferably comprises the following feature:

the holding device 30 comprises a holding and positioning projection 30*a*, which protrudes from the upper wall segment 21 and is formed to hold the door structure; or the holding device 30 comprises a holding and positioning opening, which is accessible from the upper wall segment 21 and is formed to receive projections from a lower face of the door structure and thus to hold the door structure.

The automatic door system 1 preferably comprises the following feature:

the at least one first floor rail arrangement 10 comprises at least one second levelling device, which is arranged offset from the first levelling device 45 in the longitudinal direction 6, causing a distance between the door structure and the at least one first floor rail arrangement 10 to be adjustable.

The automatic door system 1 preferably comprises the following features:

the actuation device 48 comprises a rocker 48 having two lever arms 48*a*, 48*b* that extend apart in opposite directions from a rocker axis;

the rocker 48 is arranged within the connection and/or functional element 13 or within the at least one first or second floor rail 10*a*, 10*b* of the at least one first floor rail arrangement 10;

the bolt 46 is positioned on the first lever arm 48*a;* a screw 49 can be screwed into the connection and/or functional element 13 or into the at least one first or second floor rail 10*a*, 10*b* from outside the connection and/or functional element 13 or the at least one first or second floor rail 10*a*, 10*b* via a second opening 50 in the upper wall segment 21, 16, an end of the screw 49 being bringable into contact with the second lever arm 48*b;* the rocker 48, along with the two lever arms 48*a*, 48*b* thereof, is mounted tiltable about the rocker axis in the connection and/or functional element 13 or in the at least one first or second floor rail, the bolt 46 being pushed further out of the first opening 47 the further the screw 49 is screwed into the second opening 50.

The automatic door system 1 preferably comprises the following features:

the actuation device 53 comprises a scissor frame 53 comprising a first scissor arm 53*a* and a second scissor arm 53*b*, which are articulated to one another via an articulated connection 54 in the region of the centre thereof;

the scissor frame 53 is arranged within the connection and/or functional element 13 or within the at least one first or second floor rail 10*a*, 10*b* of the at least one first floor rail arrangement 10;

the bolt 46 is positioned on the first end of the first scissor arm 53*a;* a screw 49 can be screwed into the connection and/or functional element 13 or into the at least one first or second floor rail 10*a*, 10*b* from outside the connection and/or functional element 13 or the at least one first or second floor rail 10*a*, 10*b* via a second opening 50 in the upper wall segment 21, 16, an end of the screw 49 passing through an opening in a first end of the second scissor arm 53*b*, which comprises an internal thread;

the two second ends of the two scissor arms 53*a*, 53*b* are braced on a lower wall segment 27, 18;

the bolt 46 is pushed further out of the first opening 47 the further the screw 49 is screwed through the opening in the first end of the second scissor arm 53*b* and is in contact with the second end of the first scissor arm 53*a*.

The automatic door system 1 preferably comprises the following features:

the at least one connection and/or functional element 13 comprises a hook lock 39 and a release device 40;

the hook lock 39 is arranged displaceably in the at least one connection and/or functional element 13, and can be moved and/or pivoted and/or flapped and/or snapped from a release position, in which the at least one first door leaf 2*a* of the at least one first door leaf arrangement 2 is displaceable along the longitudinal direction 6, into a blocking position, in which the at least one door leaf 2*a* is locked stationary;

in the blocking position the hook lock 39 engages in a fixing opening on the lower face 12 of the at least one door leaf 2*a;* the release device 40 is formed to transfer the hook lock 39 from the release position into the blocking position and back.

The automatic door system 1 preferably comprises the following features:

the release device 40 is arranged below the locking receiving opening 37 in the at least one connection and/or functional element 13;

the locking bolt 38, in the state where it engages in the locking receiving opening 37, contacts the release device 40, causing the release device 40 to bring about the displacement of the hook lock 39 from the release position into the blocking position.

The automatic door system 1 preferably comprises the following features:

the at least one connection and/or functional element 13 comprises an energy store device 42, in particular in the form of a spring device, the energy store device 42 is formed to displace the hook lock 39 from the blocking position into the release position while contact of the release device 40 by the locking bolt 38 remains absent.

The automatic door system 1 preferably comprises the following features:

in the closed position of the at least one first door leaf 2*a*, the movable sealing device 140 is arranged exclusively below the lower face 12 of the at least one first door leaf 2*a;* and/or during a movement of the at least one first door leaf 2*a* or during an open position of the at least one first door leaf 2*a*, the movable sealing device 140 is arranged in a receiving groove in the upper wall segment 16 of the first and/or second floor rail 10*a*, 10*b* and/or in a receiving groove in the upper wall segment 21 of the at least one connection and/or functional element 13.

The automatic door system 1 preferably comprises the following features:

the displacement device 141 comprises an electric motor, which is formed to move the sealing device 140 in the direction of the lower face 12 of the at least one first door leaf 2*a* when said leaf is in the closed position;

or the displacement device 141 comprises a lever device 141, which consists of at least two lever arms 142, 143, the first ends 142*a*, 143*a* of which are at least indirectly interconnected, the lever device being mounted pivotably;

a second end 142*b* of the first lever arm 142 is connected to the sealing device 140 or arranged thereon;

a second end 143*b* of the second lever arm 143 is arranged in such a way that, in the closed position of the at least one first door leaf 2*a*, said end:

a) comes into mechanical contact with the at least one first door leaf 2*a*; or b) comes into mechanical contact with a locking bolt 38;

causing the lever device 141 to pivot and/or to snap around, causing the movable sealing device 140 to be movable from the first position into the second position.

The automatic door system 1 preferably comprises the following feature:

the displacement device 141 is formed in such a way that, in the absence of mechanical contact on the second end 143*b* of the second lever arm 143, the lever device 141 pivots back and/or snaps back, causing the movable sealing device 140 to be movable from the second position into the first position, this taking place by way of a spring device 144 or merely under gravity.

The automatic door system 1 preferably comprises the following features:

the at least one first floor rail 10*a* and the at least one second floor rail 10*b* are equal in length; and/or the at least one first floor rail 10*a* and the at least one second floor rail 10*b* are longer than the at least one connection and/or functional element 13.

The automatic door system 1 preferably comprises the following features:

at least one second door leaf arrangement 3 is further provided, which has at least one first door leaf 3*a;* the at least one first drive device or a further drive device is operatively connected to the at least one first door leaf 3*a* of the at least one second door leaf arrangement 3, in such a way that the at least one first door leaf 3*a* of the at least one second door leaf arrangement 3 is displaceable in the longitudinal direction 6 of the door system 1 along a second sub-stage 7;

the at least one first door leaf 3*a* of the at least one second door leaf arrangement 3 comprises an engagement element, the engagement element being arranged on a lower face of the at least one first door leaf 3*a* of the at least one second door leaf arrangement 3*a*, the at least one engagement element dipping into the at least one first guide groove 15 and being guided in the longitudinal direction 6 by the at least one first guide groove 15;

the at least one first door leaf 2*a* of the at least one first door leaf arrangement 2 and the at least one first door leaf 3*a* of the at least one second door leaf arrangement 3 are movable towards one another or movable away from one another.

The automatic door system 1 preferably comprises the following features:

the at least one second floor rail arrangement 110 further comprises at least one second floor rail 110*b*, which extends in the longitudinal direction 6;

the first and second floor rail 110*a*, 110*b* of the at least one second floor rail arrangement 110 each comprise an upper wall segment 116 and two lateral wall segments 117*a*, 117*b*, which connect to the upper wall segment 116 and together enclose a cavity 119 extending in the longitudinal direction 6, the first and/or second floor rail 110*a*, 110*b*, in cross section, in the peripheral direction a) being closed by a lower wall segment 118, which is adjacent to the two side wall segments 117*a*, 117*b;* b) or being open towards the floor at least in portions, and the first and second floor rail 110*a*, 110*b* having, at least on the first end faces thereof, an engagement opening through which the cavity 119 is accessible;

the at least one connection and/or functional element 113 of the second floor rail arrangement 110 comprises at least one upper wall segment 121 and two lateral wall segments, which connect to the upper wall segment 121, and is arranged between two first end faces, facing towards one another, of the two floor rails 110*a*, 110*b*, the second floor rail 110*b* of the at least one second floor rail arrangement 110 being free of the second guide groove 115.

The automatic door system 1 preferably comprises the following features:

the at least one first guide groove 15 and the at least one second guide groove 115 are of different length.

The automatic door system 1 preferably comprises the following features:

the first support region 65*a* comprises an engagement groove 68 extending in the longitudinal direction 6;

the second support region 65*b* comprises an engagement groove 68 extending in the longitudinal direction 6;

the first dielectric insulating element 67*a* is configured hook-shaped or Z-shaped, a first end of the first dielectric insulating element 67*a* engaging in the engagement groove 68 of the first support region 65*a;* the second dielectric insulating element 67*b* is configured hook-shaped or Z-shaped, a first end of the second dielectric insulating element 67*a* engaging in the engagement groove 68 of the second support region 65*b*.

The automatic door system 1 preferably comprises the following features:

the end faces of the at least one carrier profile 60 are closed by end walls 75, 76, and a) at least one end wall 75 comprises, in the region of the base wall 61, an opening 77 having at least one tubular projection 78;

b) the base wall 61 of the at least one carrier profile 60 comprises an opening having a tubular projection; or c) at least one side wall 62*a*, 62*b* of the at least one carrier profile 60 comprises, in the region of the base wall 61, an opening having a tubular projection;

the tubular projection 78 serving to connect to a drainage pipe or drainage hose.

The automatic door system 1 preferably comprises the following feature:

the side walls 62*a*, 62*b* of the at least one carrier profile 60 end approximately flush with the at least one first floor rail arrangement 10 at the upper face 64.

The automatic door system 1 preferably comprises the following feature:

a further dielectric insulating element 131, 131*a*, 131*b* is provided, which is formed bracket-shaped and is positioned on the further support regions 130*a*, 130*b* of the at least one separating web 130 and encloses an upper face of the at least one separating web 130.

The automatic door system 1 preferably comprises the following features:

the first floor rail arrangement 10 is positioned on the support regions 65*a*, 130*a* between the first side wall 62*a* of the at least one carrier profile 60 and the separating web 130, and covers the first receiving chamber 63*a*; or the first floor rail arrangement 10 is positioned on the support region of the base wall 61 in the first receiving chamber 63*a;* and/or the second floor rail arrangement 110 is positioned on the support regions 65*b*, 130*b* between the second side wall 62*b* of the at least one carrier profile 60 and the separating web 130 and covers the second receiving chamber 63*b*; or the second floor rail arrangement 110 is positioned on the support region of the base wall 61 in the second receiving chamber 63*b*.

The invention is not limited to the described embodiments. In the context of the invention, all described and/or shown features may be combined with one another as desired.

The invention claimed is:

1. Automatic door system, in particular in the form of a sliding door or a telescopic sliding door or a folding door, comprising at least one first door leaf arrangement that has a first door leaf that is displaceable in the longitudinal direction of the door system on a first sub-stage, having the following features:

at least one first drive device is provided, which is operatively connected to the at least one first door leaf of the at least one first door leaf arrangement in such a way that the at least one first door leaf is displaceable along the first sub-stage;

a floor-side guide rail arrangement is provided, which extends in the longitudinal direction and comprises at least one first floor rail arrangement;

the at least one first door leaf of the at least one first door leaf arrangement comprises an engagement element, the engagement element being arranged on a lower face of the at least one first door leaf;

the at least one first floor rail arrangement comprises at least one first floor rail and at least one connection and/or functional element, the at least one connection and/or functional element being arranged and/or fixed on an end face of the at least one first floor rail and lengthening the first floor rail in the longitudinal direction;

the at least one first floor rail comprises at least one first guide groove extending in the longitudinal direction;

the at least one engagement element of the at least one first door leaf of the at least one first door leaf arrangement dips into the at least one first guide groove, and is guided in the longitudinal direction by the at least one first guide groove;

the at least one connection and/or functional element has a lower thermal conductivity than the at least one first floor rail of the at least one first floor rail arrangement;

the at least one first floor rail arrangement further comprises at least one second floor rail, which extends in the longitudinal direction;

the first and the second floor rail each comprise an upper wall segment and two lateral wall segments, which connect to the upper wall segment and together enclose a cavity extending in the longitudinal direction, the first and/or second floor rail, in cross section, in the peripheral direction:

a) being closed by a lower wall segment adjacent to the two side wall segments; or b) being open at least in portions towards the floor, and the first and the second floor rail having, at least on the first end faces thereof, an engagement opening through which the cavity is accessible;

the at least one connection and/or functional element comprises at least one upper wall segment and two lateral wall segments, which connect to the upper wall segment, and is arranged between two first end faces, facing towards one another, of the two floor rails, wherein:

the at least one first guide groove in the first floor rail extends within the upper wall segment;

in cross section, the first floor rail is:

a) separated by the at least one first guide groove into two mutually separated delimiting profiles or square tubes, which extend parallel;

or b) closed, causing the upper wall segment to extend offset towards the opposite lower wall segment in the region of a groove base of the first guide groove and i) to end spaced apart therefrom; or ii) to be connected thereto, causing the cavity to be subdivided into two mutually separated chambers;

or c) open towards the floor, the walls of the first guide groove extending approximately parallel to the lateral wall segments of the first floor rail, which connect to the upper wall segment;

and/or the second floor rail:

a) comprises the at least one first guide groove, which extends within the upper wall segment and, in cross section, is:

(1) separated by the at least one first guide groove into two mutually separated delimiting profiles or square tubes, which extend parallel; or (2) closed, causing the upper wall segment to extend offset towards the opposite lower wall segment in the region of the groove base of the first guide groove and i) to end spaced apart therefrom; or ii) to be connected thereto, causing the cavity to be subdivided into two mutually separated chambers;

or (3) open towards the floor, the walls of the guide groove extending approximately parallel to the lateral wall segments of the second floor rail, which connect to the upper wall segment;

or b) is free of a guide groove in the upper wall segment thereof;

and/or the at least one connection and/or functional element:

a) comprises the at least one first guide groove, which extends within the upper wall segment; and, in cross section, is:

closed, causing the upper wall segment to extend offset towards an opposite lower wall segment in the region of the groove base of the first guide groove and i) to end spaced apart therefrom; or ii) to be connected thereto, causing the cavity to be subdivided into two mutually separated chambers;

or open towards the floor, the walls of the guide groove extending approximately parallel to the lateral wall segments of the at least one connection and/or functional element, which connect to the upper wall segment;

or b) is free of a guide groove at the upper wall segment thereof, and wherein the at least one connection and/or functional element comprises a holding device, which is formed to hold a door structure such as a doorframe or glass frame.

2. Automatic door system according to claim 1, wherein:

the at least one connection and/or functional element is arranged in the first floor rail arrangement in such a way that, in a closed position of the at least one first door leaf of the at least one first door leaf arrangement, a secondary closing edge of the at least one first door leaf is positioned approximately above the at least one connection and/or functional element.

3. Automatic door system according to claim 1, wherein:

the at least one first door leaf of the at least one first door leaf arrangement comprises sealing elements, in particular in the form of a strip brush, which are arranged at least on a face alongside the engagement element, and extend parallel or transverse to the engagement element and/or to the first door leaf and extend from the lower face of the at least one first door leaf towards the upper wall segment of the first floor rail and/or second floor rail and/or connection and/or functional element of the first floor rail arrangement;

a transition between the upper wall segment and a lateral wall segment of the first floor rail and/or second floor rail and/or connection and/or functional element of the first floor rail arrangement is bevelled, one face of the sealing elements being positioned on this bevelled transition in such a way that the sealing elements, at the end thereof, extend at an inclination to the engagement element and/or at an inclination to the upper wall segment.

4. Automatic door system according to claim 1, wherein:

the at least one connection and/or functional element comprises a brush arrangement, which comprises at least one brush row that protrudes from the upper wall segment towards the lower face of the at least one first door leaf of the at least one first door leaf arrangement.

5. Automatic door system according to claim 1, wherein:

the at least one connection and/or functional element and/or the at least one first and/or second floor rail of the at least one first floor rail arrangement comprise at least one levelling device;

the at least one levelling device comprises a displaceably arranged lifting element, in particular in the form of a bolt, which is arranged in or below a first opening in the upper wall segment, and an actuation device, which is formed to push this lifting element different distances out of the first opening, a lower face of a door structure, such as a doorframe or glass frame, being positioned on the bolt, and this door structure being inclined to different extents depending on the position of the lifting element.

6. Automatic door system according to claim 1, wherein:

the at least one connection and/or functional element comprises a locking receiving opening;

a) the locking receiving opening is formed in the upper wall segment of the at least one connection and/or functional element;

the locking receiving opening is formed to receive a locking bolt that can be extended out from a lower face of the at least one first door leaf of the at least one first door leaf arrangement or that is part of a closing cylinder;

and/or b) the locking receiving opening is arranged in a wall segment that has arisen as a result of the at least one guide groove in the at least one connection and/or functional element;

the locking receiving opening is formed to displace a locking bolt out of it into the at least one first guide groove, the locking bolt being part of a closing cylinder;

the at least one engagement element of the at least one first door leaf comprises an opening;

in the closed position of the at least one first door leaf, the locking bolt can be introduced into the opening of the at least one engagement element of the at least one first door leaf, causing said leaf to be lockable.

7. Automatic door system according to claim 1, wherein:

a movable sealing device is provided;

the movable sealing device is arranged on the upper wall segment of the first and/or second floor rail and/or on the upper wall segment of the at least one connection and/or functional element;

a displacement device is provided, which is formed to move the movable sealing device from a first position, in which it is positioned in the region of the associated upper wall segment, into a second position towards the lower face of the at least one first door leaf when said leaf is in a closed position or travelling towards a closed position, the movable sealing device coming into contact with the lower face of the at least one first door leaf in the closed position of the at least one first door leaf.

8. Automatic door system according to claim 1, wherein:

in the at least one first floor rail and/or in the at least one second floor rail and/or in the at least one connection and/or functional element:

a) at least one heating element in the form of a heating wire is arranged; and/or b) the at least one first drive device, in the form of an electric motor and a spindle driven by the electric motor, is arranged; and/or c) power and/or data cables are arranged; and/or d) a control device comprising a circuit board is arranged; and/or e) a sensor device is arranged; and/or f) an LED device is arranged, which is visible from outside the floor-side guide rail arrangement; and/or g) a loudspeaker device is arranged, which is audible from outside the floor-side guide rail arrangement; and/or h) the upper wall segment is closed; or i) openings are introduced, so as to guide water into at least one carrier profile arranged below the at least one floor rail arrangement.

9. Automatic door system according to claim 1, wherein:

the floor-side guide rail arrangement comprises at least one second floor rail arrangement, which extends parallel to the first floor rail arrangement; and:

the at least one second floor rail arrangement comprises at least one second guide groove, the second guide groove extending in the longitudinal direction;

the at least one first door leaf arrangement comprises at least one second door leaf, which comprises an engagement element, the engagement element being arranged on a lower face of the at least one second door leaf;

the at least one engagement element of the at least one second door leaf of the at least one first door leaf arrangement dips into the at least one second guide groove and is guided in the longitudinal direction by the at least one second guide groove;

the at least one second floor rail arrangement comprises at least one first floor rail and at least one connection and/or functional element, the at least one connection and/or functional element being arranged and/or fixed on an end face of the at least one first floor rail and lengthening the first floor rail in the longitudinal direction;

the at least one first floor rail of the at least one second floor rail arrangement comprises the at least one second guide groove;

the at least one first door leaf arrangement is formed as a telescopic sliding door, the at least one first door leaf and the at least one second door leaf being formed as sliding door leaves that extend mutually parallel in different guide grooves and along stages of different length;

or a) the at least one first door leaf arrangement comprises at least one second, stationary door leaf, which is rigidly connected to the second floor rail arrangement.

10. Automatic door system according to claim 1, wherein:

the floor-side guide rail arrangement further comprises at least one carrier profile, which extends in the longitudinal direction and is arrangeable or arranged in a recess in the floor;

the at least one carrier profile comprises a base wall and side walls, which extend away from the base wall and together enclose a receiving space;

the receiving space is accessible via an upper face of the at least one carrier profile;

the carrier profile comprises a) at least two support regions, which are spaced apart from one another, each support region being arranged between the upper face and the base wall and extending at least along a particular length in the longitudinal direction;

or b) a support region formed by the base wall;

the at least one first floor rail arrangement is in each case positioned on an upper support face, facing towards the at least one first door leaf, of the support regions.

11. Automatic door system according to claim 10, wherein:

a first dielectric insulating element is arranged between the at least one first floor rail arrangement and the upper support face of the first support region, and a second dielectric insulating element is arranged between the upper support face of the second support region and the at least one first floor rail arrangement; or a dielectric insulating plate is arranged between the at least one first floor rail arrangement and the upper support face of the first support region and the upper support face of the second support region.

12. Automatic door system according to claim 10, wherein:

the at least one connection and/or functional element of the first floor rail arrangement comprises a continuous arresting opening and a contact pressure element;

the contact pressure element is arranged both on a lower support face, facing towards the base wall, of the first support region and on a lower support face, facing towards the base wall, of the second support region;

a screw connection passes through the arresting opening of the at least one connection and/or functional element;

the screw connection passes through the contact pressure element;

the screw connection is arranged on the at least one connection and/or functional element and the contact pressure element in such a way that when the screw connection is tightened, a distance between the at least one connection and/or functional element and the contact pressure element is reduced, causing the at least one connection and/or functional element to be pushed onto the upper support faces, and the contact pressure element being pushed onto the lower support faces, in such a way that the at least one connection and/or functional element is prevented from lifting away from the at least one carrier profile.

13. Automatic door system according to claim 10, wherein:

the side walls of the at least one carrier profile comprise, on the outer face thereof, a plurality of holding notches, which are spaced apart from one another along the height of the side walls and extend in the longitudinal direction;

a plurality of bracing brackets are provided, which each have a foot element that is bringable or has been brought into contact with a floor structure;

the bracing brackets each engage in one or more holding notches, a distance between the at least one carrier profile and a floor structure being adjustable depending on the holding notches in which the bracing brackets engage.

14. Automatic door system according to claim 10, wherein:

the side walls of the at least one carrier profile comprise a plurality of fixing openings;

a plurality of bracing brackets are provided, which each have a foot element that is bringable or has been brought into contact with a floor structure;

the bracing brackets comprise a slot, a screw connection engaging in the associated fixing opening in the carrier profile through the slot, whereby the associated bracing bracket is fixed to the carrier profile, a distance between the at least one carrier profile and a floor structure being adjustable depending on the position in the slot at which the screw connection passes through the slot of the associated bracing bracket.

15. Automatic door system according to claim 10, wherein:

a sealing film is provided, the sealing film enclosing at least the base wall and the side walls of the at least one carrier profile up to a particular height.

16. Automatic door system according to claim 10, wherein:

the at least one carrier profile is U-shaped;

the first support region is formed as a support shoulder on the first side wall and protrudes into the receiving space;

the second support region is formed as a support shoulder on the second side wall and protrudes into the receiving space.

17. Automatic door system according to claim 10, wherein:

the carrier profile further comprises an additional receiving space, which connects to or is introduced into the first or second side wall and extends in the longitudinal direction and is predominantly closed in cross section;

an upper wall of the additional receiving space is formed to hold a door structure such as a doorframe or glass frame.

18. Automatic door system according to claim 10, wherein:

at least one separating web protrudes from the base wall towards the upper face between the two side walls of the at least one carrier profile;

the at least one separating web extends in the longitudinal direction and subdivides the receiving space into a first and second receiving chamber; and a) the at least one separating web comprises further support regions that extend in the longitudinal direction;

one of these further support regions is formed as a support shoulder and protrudes into the first receiving chamber, whereas the other support region is formed as a support shoulder and protrudes into the second receiving chamber;

or b) a support region is formed in each receiving chamber by the base wall.

19. Automatic door system, in particular in the form of a sliding door or a telescopic sliding door or a folding door, comprising at least one first door leaf arrangement that has a first door leaf that is displaceable in the longitudinal direction of the door system on a first sub-stage, having the following features:

at least one first drive device is provided, which is operatively connected to the at least one first door leaf of the at least one first door leaf arrangement in such a way that the at least one first door leaf is displaceable along the first sub-stage;

a floor-side guide rail arrangement is provided, which extends in the longitudinal direction and comprises at least one first floor rail arrangement;

the at least one first door leaf of the at least one first door leaf arrangement comprises an engagement element, the engagement element being arranged on a lower face of the at least one first door leaf;

the at least one first floor rail arrangement comprises at least one first floor rail and at least one connection and/or functional element, the at least one connection and/or functional element being arranged and/or fixed on an end face of the at least one first floor rail and lengthening the first floor rail in the longitudinal direction;

the at least one first floor rail comprises at least one first guide groove extending in the longitudinal direction;

the at least one engagement element of the at least one first door leaf of the at least one first door leaf arrangement dips into the at least one first guide groove, and is guided in the longitudinal direction by the at least one first guide groove;

the at least one connection and/or functional element has a lower thermal conductivity than the at least one first floor rail of the at least one first floor rail arrangement;

the at least one first floor rail arrangement further comprises at least one second floor rail, which extends in the longitudinal direction;

the first and the second floor rail each comprise an upper wall segment and two lateral wall segments, which connect to the upper wall segment and together enclose a cavity extending in the longitudinal direction, the first and/or second floor rail, in cross section, in the peripheral direction:

a) being closed by a lower wall segment adjacent to the two side wall segments; or b) being open at least in portions towards the floor, and the first and the second floor rail having, at least on the first end faces thereof, an engagement opening through which the cavity is accessible;

the at least one connection and/or functional element comprises at least one upper wall segment and two lateral wall segments, which connect to the upper wall segment, and is arranged between two first end faces, facing towards one another, of the two floor rails, wherein:

the floor-side guide rail arrangement further comprises at least one carrier profile, which extends in the longitudinal direction and is arrangeable or arranged in a recess in the floor;

the at least one carrier profile comprises a base wall and side walls, which extend away from the base wall and together enclose a receiving space;

the receiving space is accessible via an upper face of the at least one carrier profile;

the carrier profile comprises a) at least two support regions, which are spaced apart from one another, each support region being arranged between the upper face and the base wall and extending at least along a particular length in the longitudinal direction;

or b) a support region formed by the base wall;

the at least one first floor rail arrangement is in each case positioned on an upper support face, facing towards the at least one first door leaf, of the support regions, wherein:

a first dielectric insulating element is arranged between the at least one first floor rail arrangement and the upper support face of the first support region, and a second dielectric insulating element is arranged between the upper support face of the second support region and the at least one first floor rail arrangement; or a dielectric insulating plate is arranged between the at least one first floor rail arrangement and the upper support face of the first support region and the upper support face of the second support region.

20. Automatic door system, in particular in the form of a sliding door or a telescopic sliding door or a folding door, comprising at least one first door leaf arrangement that has a first door leaf that is displaceable in the longitudinal direction of the door system on a first sub-stage, having the following features:

at least one first drive device is provided, which is operatively connected to the at least one first door leaf of the at least one first door leaf arrangement in such a way that the at least one first door leaf is displaceable along the first sub-stage;

a floor-side guide rail arrangement is provided, which extends in the longitudinal direction and comprises at least one first floor rail arrangement;

the at least one first door leaf of the at least one first door leaf arrangement comprises an engagement element, the engagement element being arranged on a lower face of the at least one first door leaf;

the at least one first floor rail arrangement comprises at least one first floor rail and at least one connection and/or functional element, the at least one connection and/or functional element being arranged and/or fixed on an end face of the at least one first floor rail and lengthening the first floor rail in the longitudinal direction;

the at least one first floor rail comprises at least one first guide groove extending in the longitudinal direction;

the at least one engagement element of the at least one first door leaf of the at least one first door leaf arrangement dips into the at least one first guide groove, and is guided in the longitudinal direction by the at least one first guide groove;

the at least one connection and/or functional element has a lower thermal conductivity than the at least one first floor rail of the at least one first floor rail arrangement;

the at least one first floor rail arrangement further comprises at least one second floor rail, which extends in the longitudinal direction;

the first and the second floor rail each comprise an upper wall segment and two lateral wall segments, which connect to the upper wall segment and together enclose a cavity extending in the longitudinal direction, the first and/or second floor rail, in cross section, in the peripheral direction:

a) being closed by a lower wall segment adjacent to the two side wall segments; or b) being open at least in portions towards the floor, and the first and the second floor rail having, at least on the first end faces thereof, an engagement opening through which the cavity is accessible;

the at least one connection and/or functional element comprises at least one upper wall segment and two lateral wall segments, which connect to the upper wall segment, and is arranged between two first end faces, facing towards one another, of the two floor rails, wherein:

the at least one first guide groove in the first floor rail extends within the upper wall segment;

in cross section, the first floor rail is:

a) separated by the at least one first guide groove into two mutually separated delimiting profiles or square tubes, which extend parallel;

or b) closed, causing the upper wall segment to extend offset towards the opposite lower wall segment in the region of a groove base of the first guide groove and i) to end spaced apart therefrom; or ii) to be connected thereto, causing the cavity to be subdivided into two mutually separated chambers;

or c) open towards the floor, the walls of the first guide groove extending approximately parallel to the lateral wall segments of the first floor rail, which connect to the upper wall segment;

and/or the second floor rail:

a) comprises the at least one first guide groove, which extends within the upper wall segment and, in cross section, is:

(1) separated by the at least one first guide groove into two mutually separated delimiting profiles or square tubes, which extend parallel; or (2) closed, causing the upper wall segment to extend offset towards the opposite lower wall segment in the region of the groove base of the first guide groove and i) to end spaced apart therefrom; or ii) to be connected thereto, causing the cavity to be subdivided into two mutually separated chambers;

or (3) open towards the floor, the walls of the guide groove extending approximately parallel to the lateral wall segments of the second floor rail, which connect to the upper wall segment;

or b) is free of a guide groove in the upper wall segment thereof;

and/or the at least one connection and/or functional element:

a)—comprises the at least one first guide groove, which extends within the upper wall segment; and, in cross section, is:

closed, causing the upper wall segment to extend offset towards an opposite lower wall segment in the region of the groove base of the first guide groove and i) to end spaced apart therefrom; or ii) to be connected thereto, causing the cavity to be subdivided into two mutually separated chambers;

or open towards the floor, the walls of the guide groove extending approximately parallel to the lateral wall segments of the at least one connection and/or functional element, which connect to the upper wall segment;

or b) is free of a guide groove at the upper wall segment thereof, and wherein the at least one connection and/or functional element comprises a brush arrangement, which comprises at least one brush row that protrudes from the upper wall segment towards the lower face of the at least one first door leaf of the at least one first door leaf arrangement.

* * * * *